US011583737B2

(12) United States Patent
Akiyama

(10) Patent No.: US 11,583,737 B2
(45) **Date of Patent: *Feb. 21, 2023**

(54) GOLF CLUB HEAD OR OTHER BALL STRIKING DEVICE HAVING IMPACT-INFLUENCING BODY FEATURES

(71) Applicant: Karsten Manufacturing Corporation, Phoenix, AZ (US)

(72) Inventor: Hiromitsu Akiyama, Tokyo (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/301,154

(22) Filed: Mar. 26, 2021

(65) Prior Publication Data

US 2021/0283472 A1 Sep. 16, 2021

Related U.S. Application Data

(63) Continuation of application No. 14/725,966, filed on May 29, 2015, now Pat. No. 10,960,273.

(51) Int. Cl.
*A63B 53/04* (2015.01)

(52) U.S. Cl.
CPC ..... *A63B 53/0466* (2013.01); *A63B 53/04* (2013.01); *A63B 53/042* (2020.08); *A63B 53/0408* (2020.08); *A63B 53/0433* (2020.08); *A63B 2209/00* (2013.01)

(58) Field of Classification Search
CPC ..... A63B 53/0466; A63B 53/0433; A63B 53/0408; A63B 53/042; A63B 2209/00
See application file for complete search history.

(56) References Cited

U.S. PATENT DOCUMENTS

| | | | |
|---|---|---|---|
| 1,854,548 | A | 4/1932 | Hunt |
| 1,916,792 | A | 7/1933 | Hadden |
| 2,346,617 | A | 4/1944 | Schaffer |
| 3,084,940 | A | 4/1963 | Cissel |
| 3,814,437 | A | 6/1974 | Winquist |
| 4,535,990 | A | 8/1985 | Yamada |
| 4,681,321 | A | 7/1987 | Chen |
| 4,928,972 | A | 5/1990 | Nakanishi |
| 5,067,715 | A | 11/1991 | Schmidt |
| 5,176,383 | A | 1/1993 | Duclos |
| 5,186,465 | A | 2/1993 | Chome |
| 5,282,625 | A | 2/1994 | Schmidt |

(Continued)

FOREIGN PATENT DOCUMENTS

| | | | |
|---|---|---|---|
| JP | H09154985 | A | 6/1997 |
| JP | H09299521 | A | 11/1997 |

(Continued)

OTHER PUBLICATIONS http://www.callawaygolf.com/golf-clubs/clearance/drivers/drivers-2015xr.html visited on Dec. 12, 2016.

(Continued)

*Primary Examiner* — William M Pierce

(57) ABSTRACT

A ball striking device, such as a golf club head, has a face with a striking surface configured for striking a ball; an elongated channel extending across a portion of the sole, wherein the sole has an elongated channel recessed from adjacent surfaces of the sole that has a plurality of troughs within the channel to help improve the efficiency of the impact with a golf ball.

20 Claims, 14 Drawing Sheets

(56) References Cited

U.S. PATENT DOCUMENTS

| | | | |
|---|---|---|---|
| 5,316,305 | A | 5/1994 | McCabe |
| 5,333,871 | A | 8/1994 | Wishon |
| 5,419,560 | A | 5/1995 | Bamber |
| 5,447,307 | A | 9/1995 | Antonious |
| 5,464,211 | A | 11/1995 | Atkins, Sr. |
| 5,464,217 | A | 11/1995 | Shenoha |
| 5,472,203 | A | 12/1995 | Schmidt |
| 5,497,995 | A | 3/1996 | Swisshelm |
| 5,516,106 | A | 5/1996 | Henwood |
| 5,584,770 | A | 12/1996 | Jensen |
| 5,586,948 | A | 12/1996 | Mick |
| 5,595,552 | A | 1/1997 | Wright |
| 5,692,972 | A | 12/1997 | Langslet |
| 5,749,795 | A | 5/1998 | Schmidt |
| 5,776,009 | A | 7/1998 | McAtee |
| 5,873,791 | A | 2/1999 | Allen |
| 5,888,148 | A | 3/1999 | Allen |
| 6,159,109 | A | 12/2000 | Langslet |
| 6,354,961 | B1 | 3/2002 | Allen |
| 6,443,857 | B1 | 9/2002 | Chuang |
| 6,551,199 | B2 | 4/2003 | Viera |
| 6,688,989 | B2 | 2/2004 | Best |
| 6,991,560 | B2 | 1/2006 | Tseng |
| 7,048,646 | B2 | 5/2006 | Yamanaka |
| 7,086,964 | B2 | 8/2006 | Chen |
| 7,294,064 | B2 | 11/2007 | Tsurumaki |
| 7,387,579 | B2 | 6/2008 | Lin |
| 7,445,563 | B1 | 11/2008 | Werner |
| 7,494,426 | B2 | 2/2009 | Nishio |
| 7,500,924 | B2 | 3/2009 | Yokota |
| 7,575,523 | B2 | 8/2009 | Yokota |
| 7,588,503 | B2 | 9/2009 | Roach |
| 7,601,077 | B2 | 10/2009 | Serrano |
| 7,749,101 | B2 | 7/2010 | Imamoto |
| 7,938,739 | B2 | 5/2011 | Cole |
| 7,997,999 | B2 | 8/2011 | Roach |
| 8,206,241 | B2 | 6/2012 | Boyd |
| 8,277,337 | B2 | 10/2012 | Shimazaki |
| 8,282,506 | B1 | 10/2012 | Holt |
| 8,337,325 | B2 | 12/2012 | Boyd |
| 8,435,134 | B2 | 5/2013 | Tang |
| 8,517,860 | B2 | 8/2013 | Albertsen |
| 8,529,368 | B2 | 9/2013 | Rice |
| 8,591,351 | B2 | 11/2013 | Albertsen |
| 8,632,419 | B2 | 1/2014 | Tang |
| 8,821,312 | B2 | 9/2014 | Burnett |
| 8,827,831 | B2 | 9/2014 | Burnett |
| 8,834,289 | B2 | 9/2014 | de la Cruz |
| 8,834,290 | B2 | 9/2014 | Bezilla |
| 8,858,360 | B2 | 10/2014 | Rice |
| 8,986,133 | B2 | 3/2015 | Bennett |
| 9,839,820 | B2 | 12/2017 | Bennett |
| 2002/0169035 | A1 | 11/2002 | Liu |
| 2002/0183134 | A1 | 12/2002 | Allen |
| 2003/0013545 | A1 | 1/2003 | Vincent |
| 2003/0130059 | A1 | 7/2003 | Billings |
| 2004/0192463 | A1 | 9/2004 | Tsurumaki |
| 2005/0032586 | A1 | 2/2005 | Willett |
| 2007/0021234 | A1 | 1/2007 | Tsurumaki |
| 2007/0026961 | A1 | 2/2007 | Hou |
| 2007/0117648 | A1 | 5/2007 | Yokota |
| 2008/0085781 | A1 | 4/2008 | Iwahori |
| 2008/0125244 | A1 | 5/2008 | Meyer |
| 2008/0146374 | A1 | 6/2008 | Beach |
| 2008/0182682 | A1 | 7/2008 | Rice |
| 2009/0075751 | A1 | 3/2009 | Gilbert |
| 2010/0273565 | A1 | 10/2010 | Stites |
| 2011/0207552 | A1 | 8/2011 | Finn |
| 2012/0289361 | A1 | 11/2012 | Beach |
| 2013/0095953 | A1 | 4/2013 | Hotaling |
| 2013/0165254 | A1 | 6/2013 | Rice |
| 2014/0045607 | A1 | 2/2014 | Hilton |
| 2014/0080623 | A1 | 3/2014 | de la Cruz |
| 2014/0080624 | A1 | 3/2014 | Galvan |
| 2014/0080627 | A1 | 3/2014 | Bennett |
| 2015/0045140 | A1 | 2/2015 | Fossum |
| 2015/0094164 | A1 | 4/2015 | Galvan |
| 2015/0217167 | A1 | 8/2015 | Frame |
| 2015/0238826 | A1 | 8/2015 | Llewellyn |
| 2016/0059093 | A1 | 3/2016 | Nielson |

FOREIGN PATENT DOCUMENTS

| | | | |
|---|---|---|---|
| JP | 2002052099 | A | 2/2002 |
| JP | 3115147 | U | 11/2005 |
| WO | 2008157691 | A2 | 12/2008 |
| WO | 2013082277 | A1 | 6/2013 |
| WO | 2014070343 | A1 | 5/2014 |

OTHER PUBLICATIONS

International Search Report and Written Opinion dated Nov. 18, 2016 for International Application No. PCT/US2016/050897 filed Sep. 9, 2016.

International Search Report and Written Opinion dated Jul. 12, 2016 for International Application No. PCT/US2015/032821 filed May 28, 2015.

GOLF CLUB HEAD OR OTHER BALL STRIKING DEVICE HAVING IMPACT-INFLUENCING BODY FEATURES

This is a continuation of U.S. patent application Ser. No. 14/725,966 filed May 29, 2015, which is incorporated in its entirety.

TECHNICAL FIELD

The invention relates generally to golf club heads and other ball striking devices that include impact influencing body features. Certain aspects of this invention relate to golf club heads and other ball striking devices that have a face member containing a portion of the ball striking face and a portion of the crown along with an elongated channel with multiple troughs or multiple elongated channels positioned on the sole oriented in the heel-to-toe direction made of a more flexible material than the remainder of the sole.

BACKGROUND

Golf clubs and many other ball striking devices may have various face and body features, as well as other characteristics that can influence the use and performance of the device. For example, users may wish to have improved impact properties, such as increased coefficient of restitution (COR) in the face, increased size of the area of greatest response or COR (also known as the "hot zone") of the face, and/or improved efficiency of the golf ball on impact. The COR is defined as a ratio of the relative speed of the ball after impact divided by the relative speed of the ball before the impact. Since a significant portion of the energy loss during an impact of a golf club head with a golf ball is a result of energy loss as the golf ball deforms, reducing deformation of the golf ball during impact may increase energy transfer and velocity of the golf ball after impact, which benefits the golfer in the form of greater distance. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to a ball striking device, such as a golf club head, having a club head body member made of a first material comprising a heel, a toe, a portion of a crown, a portion of a sole, a face member made of a second material comprising a central portion of the striking surface configured for striking a ball and a surface that comprises a portion of the crown, a sole having an elongated channel extending across a portion of the sole in a heel-to-toe direction, wherein the elongated channel is recessed from adjacent surfaces of the sole and has a plurality of troughs.

According to one aspect, the golf club head has a face member having a ball striking surface and a flange that forms a portion of the crown and a sole containing an elongated channel having a plurality of troughs recessed from the adjacent surfaces of the sole, oriented in a heel-to-toe direction.

Other aspects of the disclosure relate to a golf club or other ball striking device including a head or other ball striking device as described above and a shaft connected to the head/device and configured for gripping by a user. Aspects of the disclosure relate to a set of golf clubs including at least one golf club as described above. Yet additional aspects of the disclosure relate to a method for manufacturing a ball striking device as described above, including assembling a head as described above and/or connecting a handle or shaft to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
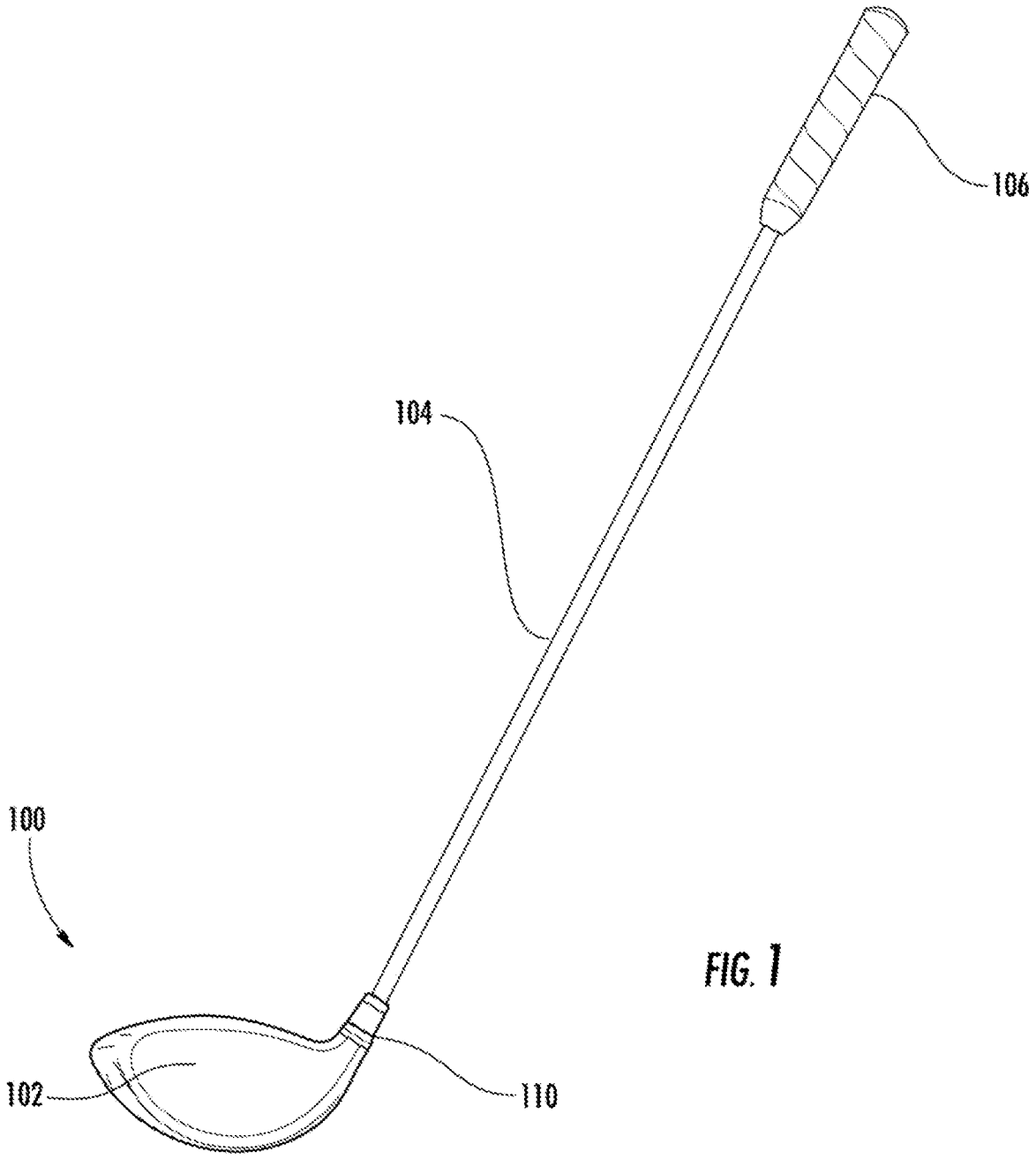
FIG. 1 is a front view of one embodiment of a golf club with a golf club head according to aspects of the disclosure, in the form of a golf driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Substantially constant" when referring to a dimension means that a value is approximately the same and varies no more than +/−5%.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including drivers, fairway woods, hybrid clubs, and the like, although aspects of this invention also may be practiced in connection with iron-type clubs, putters, and other club types as well.

According to various aspects and embodiments, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys, metal matrix composites, and other metallic materials). It is understood that the head may contain components made of several different materials, including carbon-fiber composites, polymer materials, and other components. Additionally, the components may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs. Such devices may include a one-piece construction or a multiple-piece construction. Example structures of ball striking devices according to this invention will be described in detail below in conjunction with FIGS. 1-9 which show one illustrative embodiment of a ball striking device 100 in the form of a wood-type golf club (e.g. a driver). FIGS. 10-16 illustrate alternate embodiments of a driver version of golf club head 102. As mentioned previously, aspects of this disclosure may alternately be used in connection with long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters.

The golf club 100 shown in FIG. 1 includes a golf club head or a ball striking head 102 configured to strike a ball in use and a shaft 104 connected to the ball striking head 102 and extending therefrom. FIGS. 1-9 illustrate one embodiment of a ball striking head in the form of a golf club head 102 that has a face member 112 connected to a body 108, with a hosel 110 extending therefrom and a shaft 104 connected to the hosel 110. For reference, the head 102 generally has a top or crown 116, a bottom or sole 118, a heel 120 proximate the hosel 110, a toe 122 distal from the hosel 110, a front 124, and a back or rear 126, as shown in FIGS. 1-9. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-9, the head 102 has an enclosed volume, measured per "USGA PROCEDURE FOR MEASURING THE CLUB HEAD SIZE OF WOOD CLUBS", TPX-3003, REVISION 1.0.0 dated Nov. 21, 2003, as the club 100 is a wood-type club designed for use as a driver, intended to hit the ball long distances. In this procedure, the volume of the club head is determined using the displaced water weight method. According to the procedure, any large concavities must be filled with clay or dough and covered with tape so as to produce a smooth contour prior to measuring volume. Club head volume may additionally or alternately be calculated from three-dimensional computer aided design (CAD) modeling of the golf club head. In other applications, such as for a different type of golf club, the head 102 may be designed to have different dimensions and configurations. For example, when configured as a driver, the club head 102 may have a volume of at least 400 cc, and in some structures, at least 450 cc, or even at least 470 cc. The head 102 illustrated in the form of a driver in FIGS. 1-16 has a volume of approximately 460 cc. If instead configured as a fairway wood, the head may have a volume of 120 cc to 250 cc, and if configured as a hybrid club, the head may have a volume of 85 cc to 170 cc. Other appropriate sizes for other club heads may be readily determined by those skilled in the art. The loft angle of the club head 102 also may vary, e.g., depending on the distance the club 100 is designed to hit the ball. For example, a driver golf club head may have a loft angle range of 7 degrees to 16 degrees, a fairway wood golf club head may have a loft angle range of 12 to 25 degrees, and a hybrid golf club head may have a loft angle range of 16 to 28 degrees.

The body 108 of the head 102 can have various different shapes, including a rounded shape, as in the head 102 shown in FIGS. 1-16, a generally square or rectangular shape, or any other of a variety of other shapes. It is understood that such shapes may be configured to distribute weight in any desired, manner, e.g., away from the ball striking surface 114 and/or the geometric/volumetric center of the head 102, to create a lower center of gravity and/or a higher moment of inertia.

In the illustrative embodiment illustrated in FIGS. 1-9, the head 102 has a hollow structure defining an inner cavity 103 (e.g., defined by the face member 112 and the club head body 108) with a plurality of inner surfaces defined therein. In one embodiment, the inner cavity 103 may be filled with air. However, in other embodiments, the inner cavity 103 could be filled or partially filled with another material, such as foam or hot melt glue. In still further embodiments, the solid materials of the head may occupy a greater proportion of the volume, and the head may have a smaller cavity or no inner cavity 103 at all. It is understood that the inner cavity 103 may not be completely enclosed in some embodiments.

Figure 3:
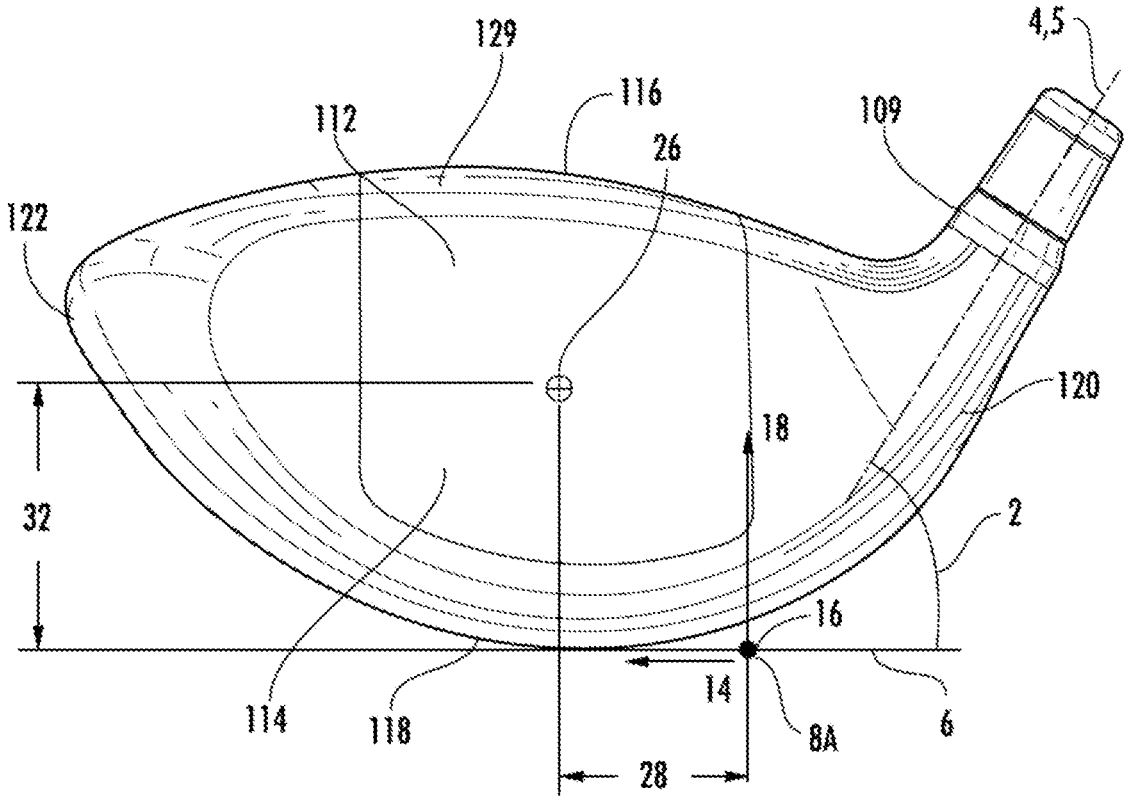
FIG. 3 is a front view of the club head of FIG. 1, showing a ground plane origin point.

The face member 112 is located at the front 124 of the head 102 and comprises a portion of the ball striking surface (or striking surface) 111 located thereon, an inner surface 107 opposite the ball striking surface 111, and a flange 129 as illustrated in FIG. 3. The edges 128 of the ball striking surface may be defined as the boundaries of an area of the ball striking surface 114 that is specifically designed to contact the ball in use, and may be recognized as the boundaries of an area of the ball striking surface 114 that is intentionally shaped and configured to be suited for ball contact. The ball striking surface 114 has an outer periphery formed of a plurality of outer or peripheral edge 128. The ball striking surface 114 comprises a portion of the ball striking surface 111 of face member 112 along with the other portions of the ball striking surface at the toe 117 and at the heel 115 within the peripheral edge 128. The face member's ball striking surface 111 may make up at least 70 percent of the surface area of the ball striking surface 114, or at least 80 percent of the surface area of the ball striking surface 114, or 100 percent of the surface area of the ball striking surface 114.

The face member 112 also has a flange 129 that comprises a portion of the crown surface 116. The addition of the flange onto the face member moves the weld or connecting feature of the face to the body away from the striking face thereby helping to improve the strength in that region, which can improve the impact efficiency and durability of the striking face. For example, the face member 112 may be made of a material, which may have a modulus of elasticity lower than the material used for the club head body or the face member material may be the same material as the club head body. For example, the face member material may be a titanium alloy like Ti-6Al-4V alloy or similar titanium alloy, a beta-titanium alloy, a steel alloy, gum metal™, an amorphous metal, or even a polymer or non-metallic material. As an alternate embodiment, the face member 112 may comprise only the ball striking surface portion 111 as a face-pull construction.

In general, the ball striking head 102 according to the present invention includes features on the body 108 that influence the impact of a ball on the face member 112, such as one or more channels 140 positioned on the body 108 of the head 102 that allow at least a portion of the body 108 to flex, produce a reactive force, and/or change the behavior or motion of the face member 112, during impact of a ball on the face member 112. In the golf club 100 shown in FIGS. 1-10, the head 102 includes a channel 140 with a plurality of troughs 150, 155 located on the sole 118 of the head 102. The channel 140 in this embodiment has a curved and generally semi-circular cross-sectional shape or profile, with multiple troughs 150, 155 and sloping, depending front side walls 151, 153 and sloping depending rear side walls 152, 154 that may be smoothly curvilinear, extending from the troughs 150, 155 to the respective edges of the channel 140. The troughs 150, 155 may be defined by walls connecting the side walls 151, 152, 153, 154 having an inflection point open to the exterior of the club head. The troughs may be connected together in a series-type of configuration. For example, the embodiment shown in FIG. 8A would have two troughs open to the exterior. Having multiple troughs may provide for a channel with properties such as a stiffer forward portion of the channel and a more flexible aft portion of the channel or a more flexible forward portion and a stiffer aft portion of the channel.

The various embodiments of golf clubs 100 and/or golf club heads 102 described herein may include components that have sizes, shapes, locations, orientations, etc., that are described with reference to one or more properties and/or reference points. Several of such properties and reference points are described in the following paragraphs, with reference to FIGS. 3-8.

As illustrated in FIG. 3, a lie angle 2 is defined as the angle formed between the hosel axis 4 or a shaft axis 5 and a horizontal plane contacting the sole 118, i.e., the ground plane 6. It is noted that the hosel axis 4 and the shaft axis 5 are central axes along which the hosel 110 and shaft 104 extend.

Figure 4:
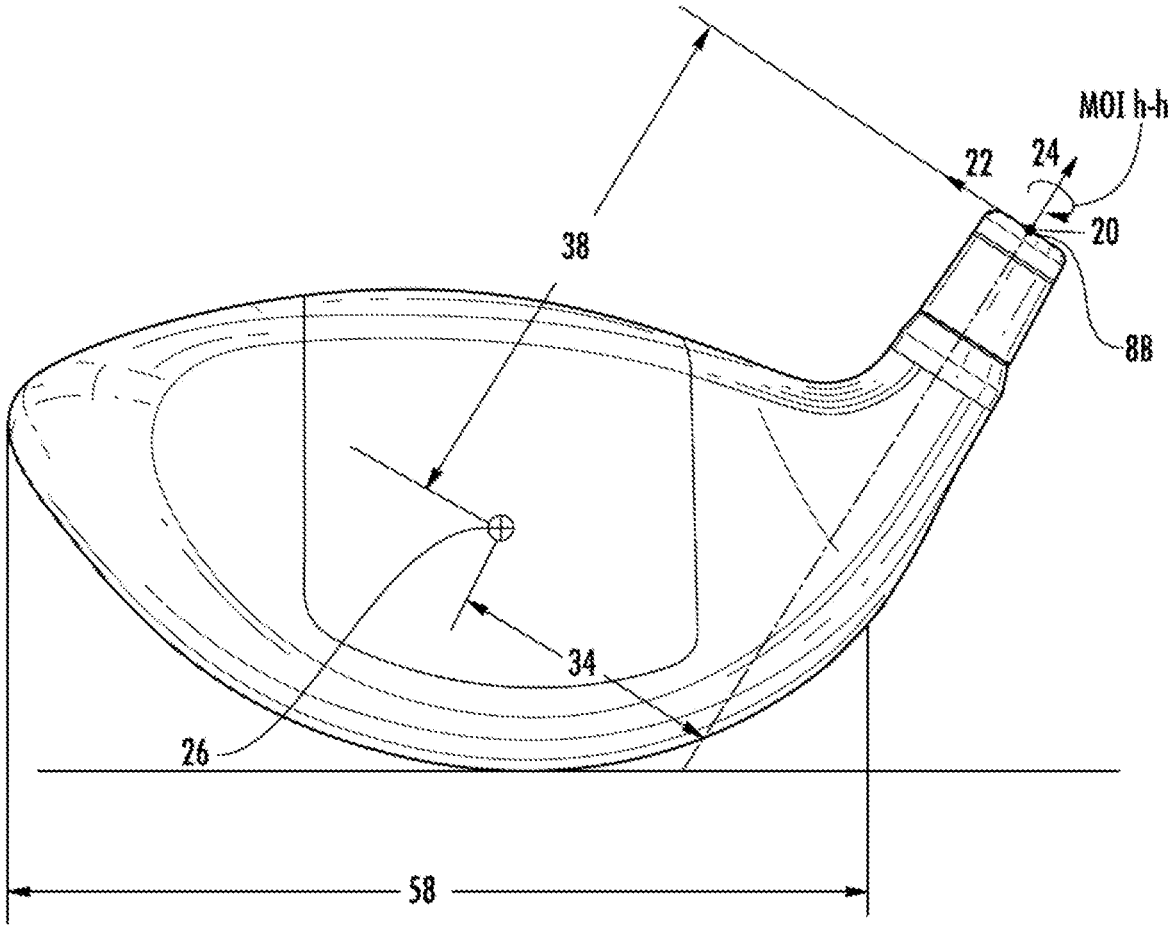
FIG. 4 is a front view of the club head of FIG. 1, showing a hosel origin point.

One or more origin points 8 (e.g., 8A, 8B) may be defined in relation to certain elements of the golf club 100 or golf club head 102. Various other points, such as a center of gravity, a sole contact, and a face center, may be described and/or measured in relation to one or more of such origin points 8. FIGS. 3 and 4 illustrate two different examples such origin points 8, including their locations and definitions. A first origin point location, referred to as a ground plane origin point 8A is generally located at the ground plane 6. The ground plane origin point 8A is defined as the point at which the ground plane 6 and the hosel axis 4 intersect. A second origin point location, referred to as a hosel origin point 8B, is generally located on the hosel 110. The hosel origin point 8B is defined on the hosel axis 4 and coincident with the uppermost edge of the hosel 110. Either location for the origin point 8, as well as other origin points 8, may be utilized for reference without departing from this invention. It is understood that references to the ground plane origin point 8A and hosel origin point 8B are used herein consistent with the definitions in this paragraph, unless explicitly noted otherwise. Throughout the remainder of this application, the ground plane origin point 8A will be utilized for all reference locations, tolerances, calculations, etc., unless explicitly noted otherwise.

As illustrated in FIG. 3, a coordinate system may be defined with an origin located at the ground plane origin point 8A, referred to herein as a ground plane coordinate system. In other words, this coordinate system has an X-axis 14, a Y-axis 16, and a Z-axis 18 that all pass through the ground plane origin point 8A. The X-axis in this system is parallel to the ground plane and generally parallel to the striking surface 114 of the golf club head 102. The Y-axis 16 in this system is perpendicular to the X-axis 14 and parallel to the ground plane 6, and extends towards the rear 126 of the golf club head 102, i.e., perpendicular to the plane of the drawing sheet in FIG. 3. The Z-axis 18 in this system is perpendicular to the ground plane 6, and may be considered to extend vertically. Throughout the remainder of this application, the ground plane coordinate system will be utilized for all reference locations, tolerances, calculations, etc., unless explicitly noted otherwise.

Figure 5:
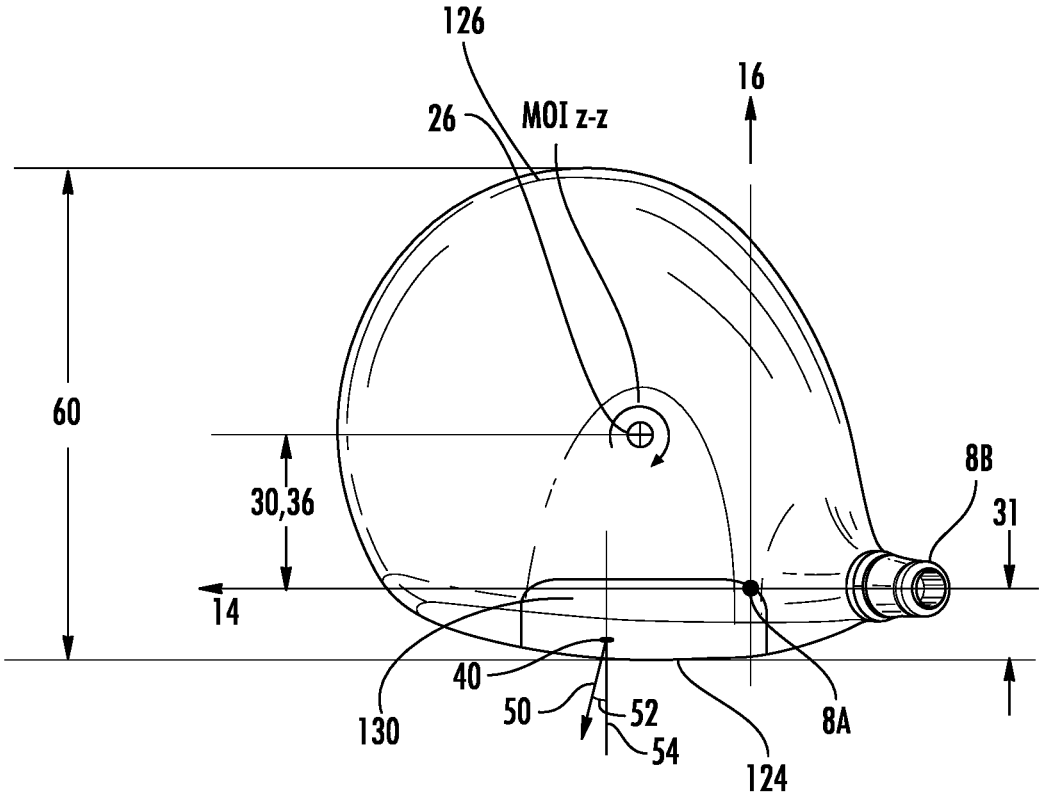
FIG. 5 is a top view of the club head of FIG. 1.

FIGS. 3 and 5 illustrate an example of a center of gravity location 26 as a specified parameter of the golf club head 102, using the ground plane coordinate system. The center of gravity of the golf club head 102 may be determined using various methods and procedures known and used in the art. The golf club head 102 center of gravity location 26 is provided with reference to its position from the ground plane origin point 8A. As illustrated in FIGS. 3 and 5, the center of gravity location 26 is defined by a distance CGX 28 from the ground plane origin point 8A along the X-axis 14, a distance CGY 30 from the ground plane origin point 8A along the Y-axis 16, and a distance CGZ 32 from the ground plane origin point 8A along the Z-axis 18.

Additionally as illustrated in FIG. 4, another coordinate system may be defined with an origin located at the hosel origin point 8B, referred to herein as a hosel axis coordinate system. In other words, this coordinate system has an X' axis 22, a Y' axis 20, and a Z' axis 24 that all pass through the hosel origin point 8B. The Z' axis 24 in this coordinate system extends along the direction of the shaft axis 5 (and/or the hosel axis 4). The X' axis 22 in this system extends parallel with the vertical plane and normal to the Z' axis 24. The Y' axis 20 in this system extends perpendicular to the X' axis 22 and the Z' axis 24 and extends toward the rear 126 of the golf club head 102, i.e., the same direction as the Y-axis 16 of the ground plane coordinate system.

FIG. 4 illustrates an example of a center of gravity location 26 as a specified parameter of the golf club head 102, using the hosel axis coordinate system. The center of gravity of the golf club head 102 may be determined using various methods and procedures known and used in the art. The golf club head 102 center of gravity location 26 is provided with reference to its position from the hosel origin point 8B. As illustrated in FIG. 4, the center of gravity location 26 is defined by a distance ΔX 34 from the hosel origin point 8B along the X' axis 22, a distance ΔY (not shown) from the hosel origin point 8B along the Y' axis 20, and a distance ΔZ 38 from the hosel origin point 8B along the Z' axis 24.

Figure 6:
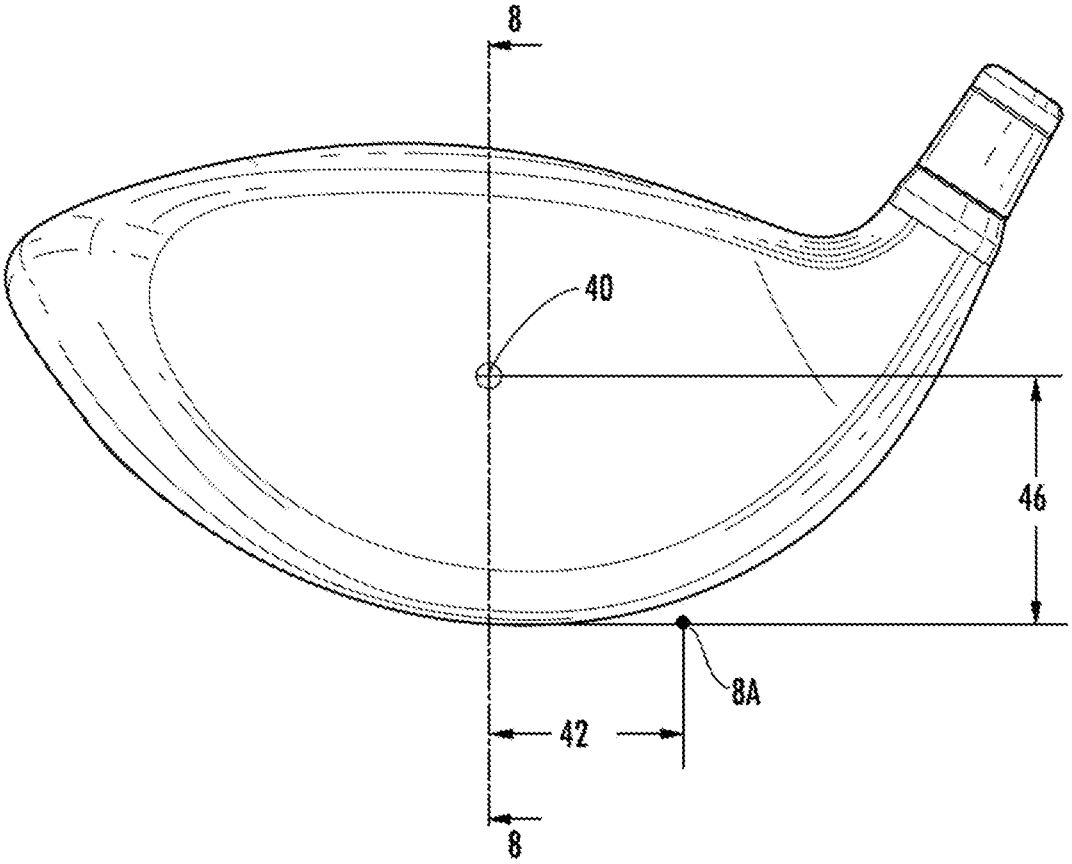
FIG. 6 is a front view of the club head of FIG. 1.

FIGS. 5 and 6 illustrate the face center (FC) location 40 on a golf club head 102. The face center location 40 illustrated in FIGS. 4 and 5 is determined using United States Golf Association (USGA) standard measuring procedures from the "Procedure for Measuring the Flexibility of a Golf Clubhead", USGA TPX-3004, Revision 2.0, Mar. 25, 2005. Using this USGA procedure, a template is used to locate the FC location 40 from both a heel 120 to toe 122 location and a crown 116 to sole 118 location. For measuring the FC location 40 from the heel-to-toe location, the template should be placed on the striking surface 114 until the measurements at the edges of the striking surface 114 on both the heel 120 and toe 122 are equal. This marks the FC location 40 from a heel-to-toe direction. To find the face center from a crown to sole dimension, the template is placed on the striking surface 114 and the FC location 40 from crown to sole is the location where the measurements from the crown 116 to sole 118 are equal. The FC location 40 is the point on the striking surface 114 where the crown-to-sole measurements on the template are equidistant, and the heel-to-toe measurements are equidistant.

As illustrated in FIGS. 5 and 6, the FC location 40 can be defined from the ground plane origin coordinate system, such that a distance CFX 42 is defined from the ground plane origin point 8A along the X-axis 14, a distance CFY 44 is defined from the ground plane origin point 8A along the Y-axis 16, and a distance CFZ 46 is defined from the ground plane origin point 8A along the Z-axis 18. It is understood that the FC location 40 may similarly be defined using the hosel origin system, if desired. The face progression (FP) 31 may be determined as the distance from the center axis of the hosel or origin point 8A to the forward most edge of the head 102 along the Y-Axis 16.

Figure 7:
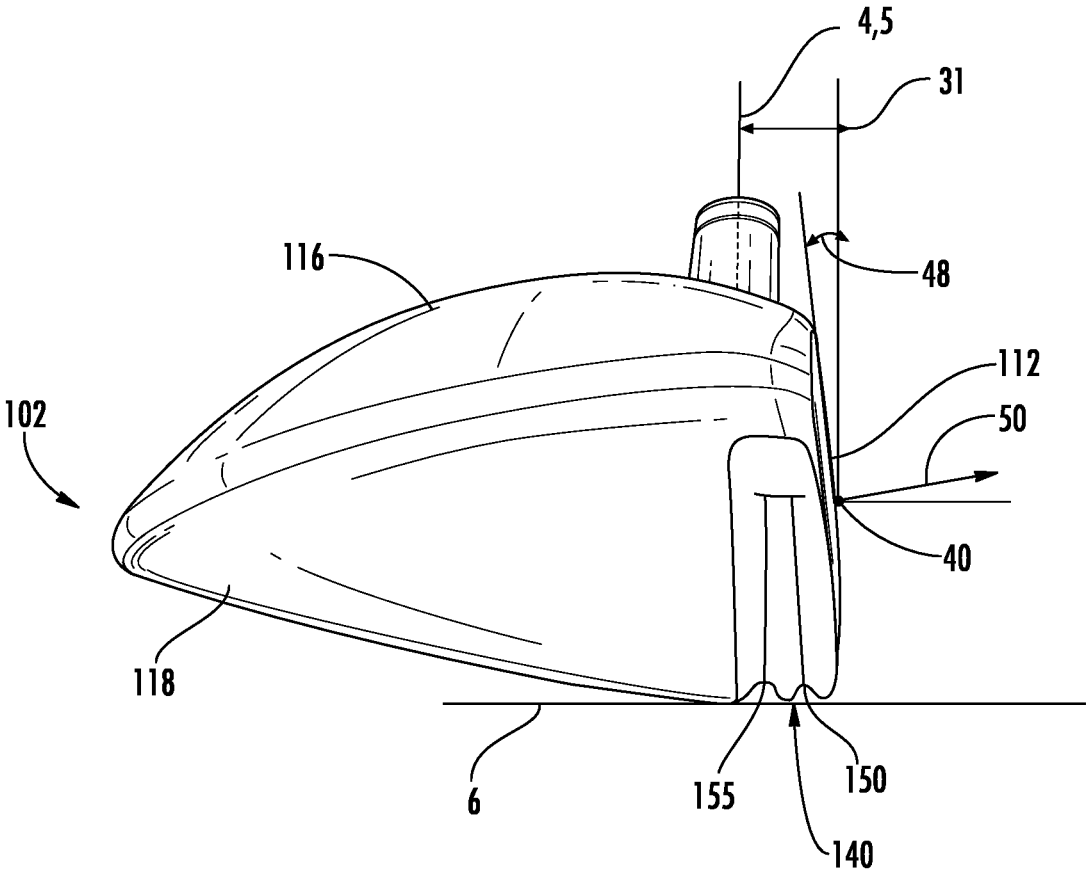
FIG. 7 is a side view of the club head of FIG. 1.

FIG. 7 illustrates an example of a loft angle 48 of the golf club head 102. The loft angle 48 can be defined as the angle between plane 51 that is tangential to the club head at the FC location 40 and a plane normal or perpendicular to the ground plane 6. Alternately, the loft angle 48 can be defined as the angle between an axis 50 normal or perpendicular to the striking surface 114 at the FC location 40, called a face center axis 50, and the ground plane 6. It is understood that each of these definitions of the loft angle 48 may yield the substantially the same loft angle measurement.

FIG. 5 illustrates an example of a face angle 52 of a golf club head 102. As illustrated in FIG. 5, the face angle 52 is defined as the angle between the face center axis 50 and a plane 54 perpendicular to the X-axis 14 and the ground plane 6.

FIG. 3 illustrates a golf club head 102 oriented in a reference position. In the reference position, the hosel axis 4 or shaft axis 5 lies in a vertical plane, as shown in FIG. 7. As illustrated in FIG. 3, the hosel axis 4 may be oriented at the lie angle 2. The lie angle 2 selected for the reference position may be the golf club 100 manufacturer's specified lie angle. If a specified lie angle is not available from the manufacturer, a lie angle of 60 degrees can be used. Furthermore, for the reference position, the striking surface 114 may, in some circumstances, be oriented at a face angle 54 of 0 degrees. The measurement setup for establishing the reference position can be found determined using the "Procedure for Measuring the Club Head Size of Wood Clubs", TPX-3003, and Revision 1.0.0, dated Nov. 21, 2003.

As golf clubs have evolved in recent years, many have incorporated head/shaft interconnection structures connecting the shaft 104 and club head 102. These interconnection structures are used to allow a golfer to easily change shafts for different flex, weight, length or other desired properties. Many of these interconnection structures have features whereby the shaft 104 is connected to the interconnection structure at a different angle than the hosel axis 4 of the golf club head, including the interconnection structures discussed elsewhere herein. This feature allows these interconnection structures to be rotated in various configurations to potentially adjust some of the relationships between the club head 102 and the shaft 104 either individually or in combination, such as the lie angle, the loft angle, or the face angle. As such, if a golf club 100 includes an interconnection structure, it shall be attached to the golf club head when addressing any measurements on the golf club head 102. For example, when positioning the golf club head 102 in the reference position, the interconnection structures should be attached to the structure. Since this structure can influence the lie angle, face angle, and loft angle of the golf club head, the interconnection member shall be set to its most neutral position. Additionally, these interconnection members have a weight that can affect the golf club heads mass properties, e.g. center of gravity (CG) and moment of inertia (MOI) properties. Thus, any mass property measurements on the golf club head should be measured with the interconnection member attached to the golf club head.

The moment of inertia is a property of the club head 102, the importance of which is known to those skilled in the art. There are three moment of inertia properties referenced herein. The moment of inertia with respect to an axis parallel to the X-axis 14 of the ground plane coordinate system, extending through the center of gravity 26 of the club head 102, is referenced as the MOI x-x, as illustrated in FIG. 7. The moment of inertia with respect to an axis parallel to the Z-axis 18 of the ground plane coordinate system, extending through the center of gravity 26 of the club head 102, is referenced as the MOI z-z, as illustrated in FIG. 5. The moment of inertia with respect to the Z' axis 24 of the hosel axis coordinate system is referenced as the MOI h-h, as illustrated in FIG. 4. The MOI h-h can be utilized in determining how the club head 102 may resist the golfer's ability to close the clubface during the swing.

Figure 8:
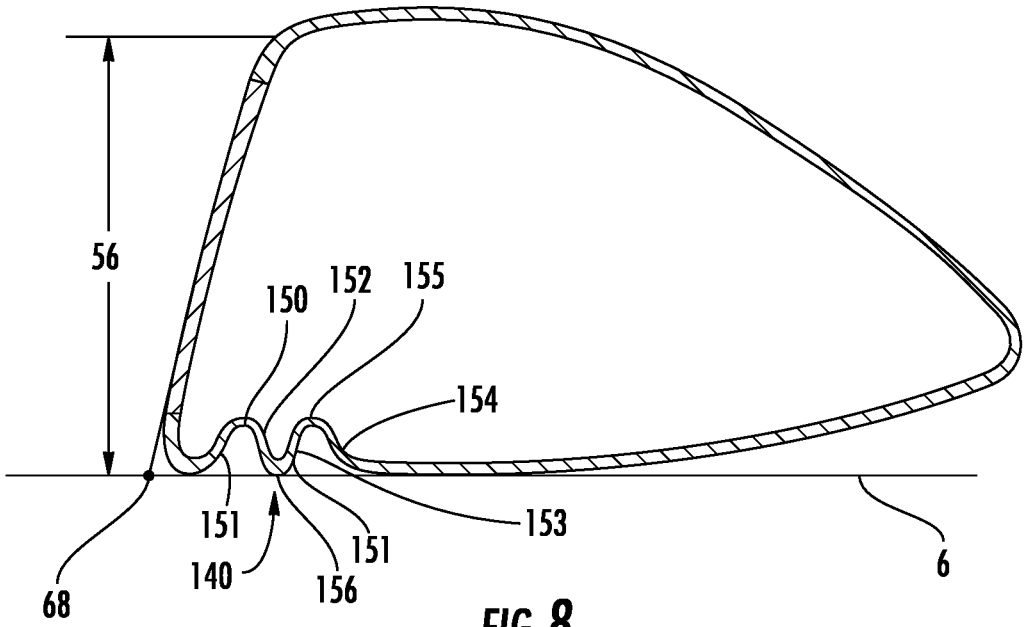
FIG. 8 is a cross-section view taken along line 8-8 of FIG. 6, with a magnified portion also shown.

The ball striking face height (FH) 56 is a measurement taken along a plane normal to the ground plane and defined by the dimension CFX 42 through the face center 40, of the distance between the ground plane 6 and a point represented by a midpoint 62 of a radius between the crown 116 and the face member 112. An example of the measurement of the face height 56 of a head 102 is illustrated in FIG. 8. It is understood that the club heads 102 described herein may be produced with multiple different loft angles, and that different loft angles may have some effect on face height 56.

The head length 58 and head breadth 60 measurements can be determined by using the USGA "Procedure for Measuring the Club Head Size of Wood Clubs," USGA-TPX 3003, Revision 1.0.0, dated Nov. 21, 2003. Examples of the measurement of the head length 58 and head breadth 60 of a head 102 are illustrated in FIGS. 4 and 5.

In the golf club 100 shown in FIGS. 1-16, the head 102 has dimensional characteristics that define its geometry and also has specific mass properties that can define the performance of the golf club as it relates to the ball flight that it imparts onto a golf ball during the golf swing or the impact event itself. This illustrative embodiment and other embodiments are described in greater detail below.

The head 102 as shown in FIGS. 1-16 illustrates a driver golf club head. As known to one skilled in the art, the mass properties of a club head may have a significant effect on the impact efficiency. The head 102 may have a head weight of approximately 198 to 210 grams, or 190 to 220 grams or even 188 to 240 grams. The head 102 may have an MOI x-x of approximately 2500 $g*cm^2$ to 2700 $g*cm^2$, or approximately 2400 $g*cm^2$ to 2800 $g*cm^2$, or approximately 2000 $g*cm^2$ to 3000 $g*cm^2$. Additionally, the head 102 may have an MOI z-z of approximately 4400 $g*cm^2$ to 4800 $g*cm^2$, or approximately 4200 $g*cm^2$ to 5000 $g*cm^2$, or approximately 4000 $g*cm^2$ to 5400 $g*cm^2$. The head 102 when configured as a driver generally has a head length ranging of approximately 119 mm, or in a range between 115 mm to 122 mm, or in a range of 105 mm to 132 mm and a head breadth of approximately 117 mm, or in a range between 113 mm to 119 mm, or in a range between 103 mm to 129 mm. Alternatively, the head 102 when configured as a fairway wood or hybrid may have a head length, breadth and MOI ranges lower than those of a driver.

The golf club 100 may include a shaft 104 connected to or otherwise engaged with the ball striking head 102 as shown in FIG. 1. The shaft 104 is adapted to be gripped by a user to swing the golf club 100 to strike the ball. The shaft 104 can be formed as a separate piece connected to the head 102, such as by connecting to the hosel 110, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. The head 102 may have an opening or other access 170 for the adjustable hosel 110 connecting structure that extends through the sole 118, as seen in FIGS. 1-9. In other illustrative embodiments, at least a portion of the shaft 104 may be an integral piece with the head 102, and/or the head 102 may not contain a hosel 110, may contain an internal hosel structure, or may not extend through the sole 118. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 106 may be positioned on the shaft 104 to provide a golfer with a slip resistant surface with which to grasp the golf club shaft 104, as seen in FIG. 1. The grip element may be attached to the shaft 104 in any desired manner, including in conventional manners known and used in the art (e.g., via adhesives or cements, threads or other mechanical connectors, swedging/swaging, etc.).

The golf club head 102 in the embodiments shown in FIGS. 1-16 include a channel 140 with a plurality of troughs positioned within the sole 118 of the head 102, and which may extend across at least a portion of the sole 118. In other embodiments, the head 102 may have a channel 140 with a plurality of troughs positioned differently, such as on the crown 116, the heel 120, and/or the toe 122. It is also understood that the head 102 may have more than one channel 140, or may have an annular channel extending around the entire or substantially the entire head 102.

Figure 2:
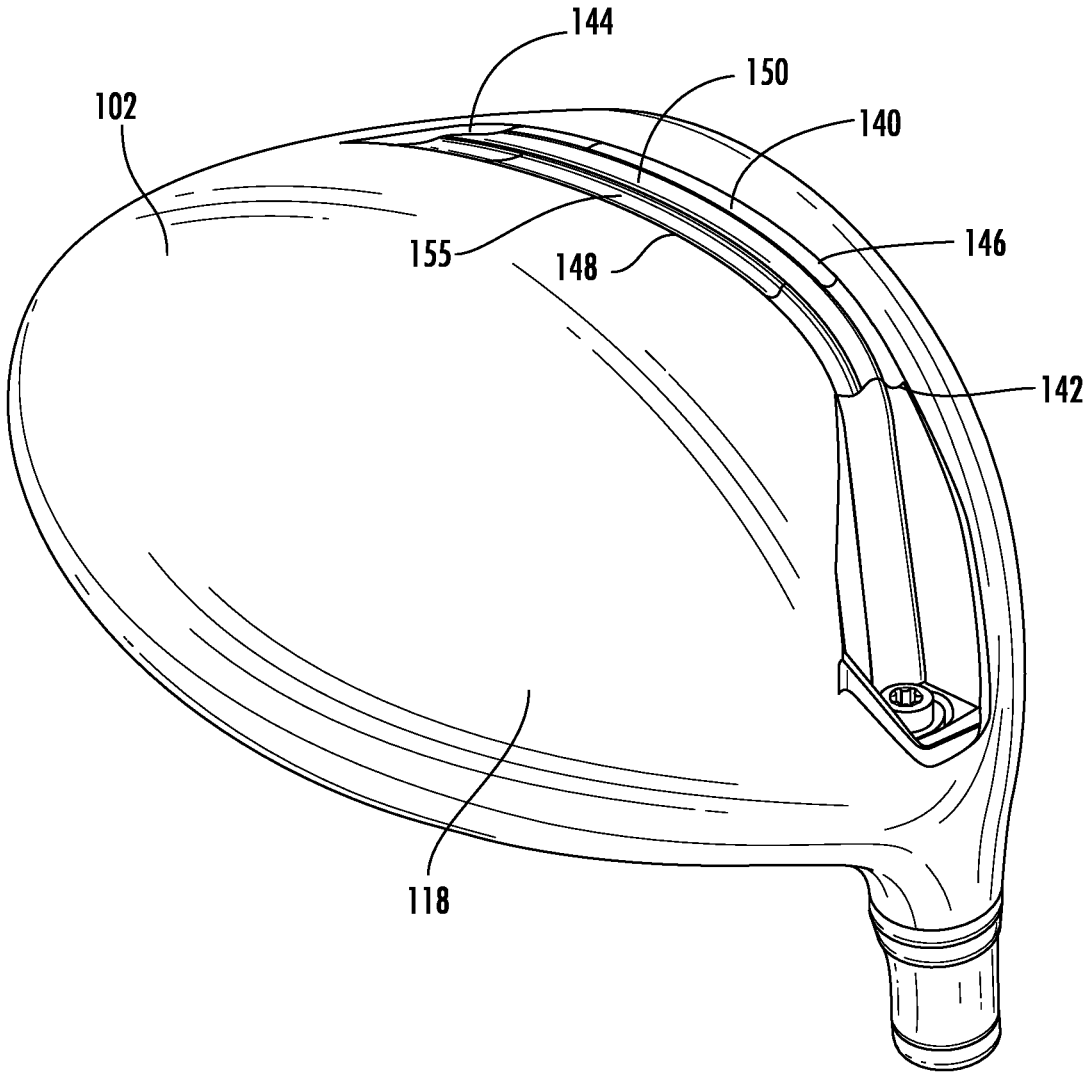
FIG. 2 is a bottom right rear perspective view of the golf club head of FIG. 1.
Figure 9:
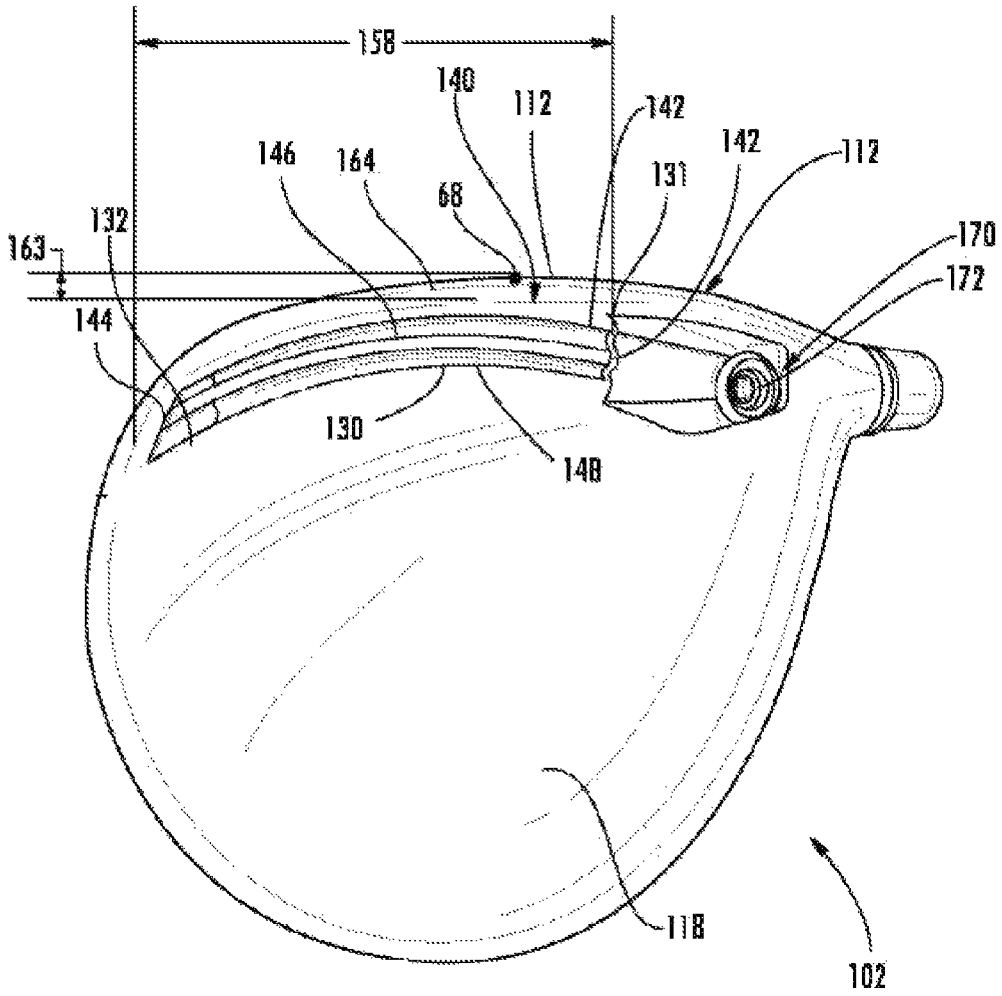
FIG. 9 is a bottom view of the club head of FIG. 1.

As illustrated in FIGS. 2 and 9, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 142, 144. In this embodiment, the channel 140 extends across the sole, adjacent to and along the bottom edge 128 of the face member 112, and further extends proximate the heel 120 and toe 122 areas of the head 102. The channel 140 may be recessed inwardly with respect to the immediately adjacent surfaces of the head 102 that extend from and/or are in contact with the edges 146, 148 of the channel 140, as shown in FIGS. 2 and 9. It is understood that, with a head 102 having a thin-wall construction (e.g., the embodiments of FIGS. 1-16), the recessed nature of the channel 140 creates corresponding raised portions on the inner surfaces of the body 108.

FIG. 9 shows a bottom view of the embodiment of FIGS. 1-9. As illustrated in FIG. 9, the forward most edge 146 of the channel 140 may be generally parallel to the ball striking surface 114. The ball striking surface 114 may have a bulge radius measuring from heel-to-toe and a roll radius measuring from crown to sole. This bulge and roll radii may measure between 200 mm to 460 mm. Alternatively, the forward most edge 146 may not have any curvature. The rear most edge 148 generally parallel to the forward most edge 146, however, alternatively, the rear most edge 148 may not be generally parallel to the forward most edge 146.

The channel 140 may have an overall width W that is the summation of the widths of the individual troughs for any given cross-section along the X-axis 14. The width W may vary in different portions of the channel 140. The width W of the channel 140 may be measured with respect to different reference points. For example, the width W of the channel 140 may be measured between radius end points (see points E in FIG. 8A), which represent the end points of the radii or fillets of the front edge 146 and the rear edge 148 of the channel 140, or in other words, the points where the recession of the channel 140 from the body 108 begins. This measurement can be made by using a straight virtual line segment that is tangent to the end points of the radii or fillets as the channel 140 begins to be recessed into the body 108. This may be considered to be a comparison between the geometry of the body 108 with the channel 140 and the geometry of an otherwise identical body that does not have the channel 140.

Figure 8A:
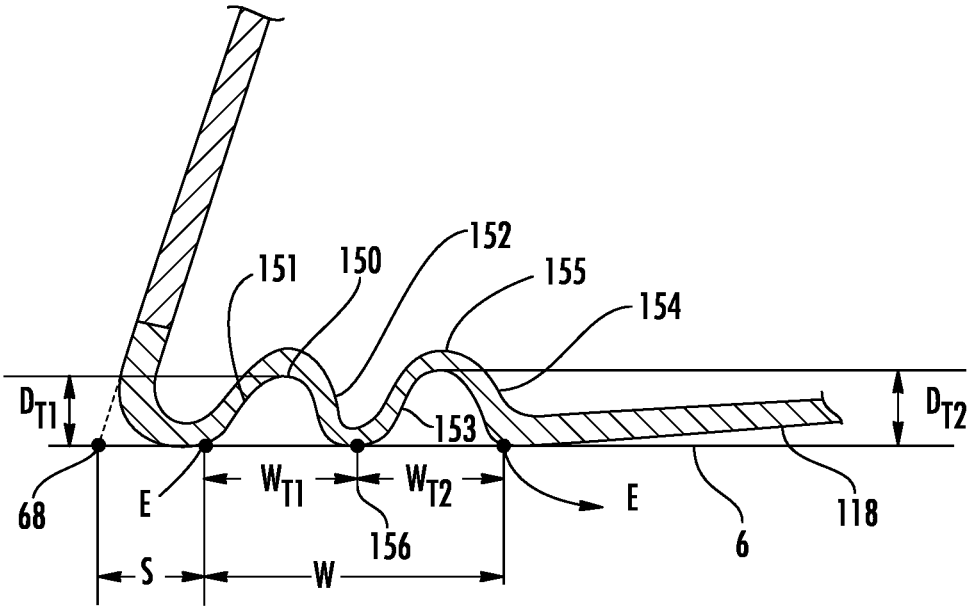
FIG. 8A is a magnified view of a portion of FIG. 8.

As illustrated in FIGS. 8A and 9, the width $W_{TX}$ of the troughs may be defined using a same straight virtual line segment method as the overall width, W, that is tangent between the radius end point, E, as the channel begins to be recessed into the body to an inflection point of the wall 156 connecting the sloping rear side wall 152 of the first trough 150 to the sloping front side wall 153 of the second trough 155, where the inflection point of wall 156 is open to the interior chamber of the head, and where x is the subsequently ordered inflection point of each trough where 1 designates the trough closest to the ball striking surface. For example in FIG. 8A, the channel having two troughs 150, 155 defined by the walls having the inflection points open to the exterior of the head and the wall 156 having an inflection point open to the interior chamber of the club head would have a width at a given cross-section of $W_{T2}$ and $W_{T2}$ representing the distance between the inflection points and the radius end points, E.

Additionally, the depth $D_{TX}$ of the troughs may be defined similarly to the width using a straight virtual line where the distance $D_{TX}$ is measured along a direction perpendicular to a line defined by the tangent to the end points of the radii where the channel begins and the inflection point of the wall 156 where x is the subsequently ordered trough where 1 designates the trough closest to the ball striking surface. For example in FIG. 8A, the channel having two troughs 150, 155 having walls with the inflection points open to the exterior of the head and the wall 156 having an inflection point open to the interior chamber of the club head would have corresponding depths at a given cross-section of $D_{T1}$ and $D_{T2}$ between the inflection points.

A rearward spacing S of the channel 140 from the sole-face intersection point 68 along the Y-axis 16 direction to a forward most point defined using the radius end point (E) of the front edge 146 of the channel 140. If the reference points for measurement of the channel 140 width W, trough 150, 155 width $W_{TX}$ and/or trough 150, 155 depth $D_{TX}$ are not explicitly described herein with respect to a particular example or embodiment, the radius end points may be considered the reference points for channel 140 width W, trough 150, 155 width $W_{TX}$ and/or trough 150, 155 depth $D_{TX}$ measurement. Properties such as width W, width $W_{TX}$, depth $D_{TX}$, and rearward spacing S, etc., are consistent in all embodiments.

The head 102 in the embodiment illustrated in FIGS. 1-9 has a channel 140 that generally has a substantially constant width W (front to rear) from adjacent surfaces of the sole 118. The channel 140 may have a center portion 130 and heel and toe portions 131, 132. In this configuration, the front edge 146 and the rear edge 148 are both generally parallel to the bottom edge of the face member 112 and/or generally parallel to each other along the entire length. In this configuration, the front and rear edges 146, 148 may generally follow the curvature of the bulge radius of the face member 112. In other embodiments, the front edge 146 and/or the rear edge 146 may be angled, curved, etc. with respect to each other and/or with respect to the adjacent edges of the face member 112. The depths of the troughs $D_{TX}$ of the heel and toe portions 131, 132 of the channel 140 may also decrease from the center portion 130 toward the heel 120 and toe 122, respectively. Further, in the embodiment shown in FIGS. 2 and 8, the front edge 146 and rear edge 148 at the heel and toe portions 131, 132 are generally parallel to the adjacent edge 128 of the face member 112. In one embodiment, the access 170 for the adjustable hosel 110 connecting structure 172 may be in communication with and/or may intersect the channel 140, such as in the head 102 illustrated in FIGS. 2 and 8, in which the access 170 is in communication with and intersects the heel portion 131 of the channel 140. The heel portion 131 around the access 170 may be wider than the channel center and toe portions 130, 132 as the portion of the heel channel 131 transitioning to the access 170. The access 170 in this embodiment may include an opening within the channel 140 that receives a part of the hosel interconnection structure 172. In other embodiments, the channel 140 may be oriented and/or positioned differently. For example, the channel 140 may be oriented adjacent to a different portion of edge 128 of the face member 112, and at least a portion of the channel 140 may be parallel or generally parallel to one or more of the edges of the face member 112. The size and shape of the channel 140 also may vary widely without departing from this invention.

In one embodiment of a club head 102 as shown in FIGS. 1-9, the depth $D_{TX}$ of the center portion 130 of any trough within the channel 140 may be approximately 4 mm, or may be in the range of 2 mm to 6 mm in another embodiment. Additionally, in one embodiment of a club head 102 as shown in FIGS. 1-9, the width $W_{TX}$ of any trough of the center portion of the channel 140 may be approximately 8 mm, or may be in the range of 5 mm to 10 mm, or may be in a range of 3 mm to 12 mm. It is understood that the troughs may have different configurations in another embodiment.

The channel 140 is substantially symmetrically positioned on the head 102 in the embodiment illustrated in FIGS. 1-9, such that the center portion 130 is generally symmetrical with respect to a vertical plane passing through the geometric centerline of the sole 118 and/or the body 108, and the midpoint of the center portion 130 may also be coincident with such a plane. However, in another embodiment, the center portion 130 may additionally or alternately be symmetrical with respect to a vertical plane (generally normal to the face member 112) passing through the geometric center of the face member CFX 42 (which may or may not be aligned the geometric center of the sole 118 and/or the body 108), and the midpoint of the center portion 130 may also be coincident with such a plane. This arrangement and alignment may be different in other embodiments, depending at least in part on the degree of geometry and symmetry of the body 108 and the face member 112. For example, in another embodiment, the center portion 130 may be asymmetrical with respect to one or more of the planes discussed above, and the midpoint may not coincide with such plane(s). This configuration can be used to vary the effects achieved for impacts on desired portions of the face member 112 and/or to compensate for the effects of surrounding structural features on the impact properties of the face member 112.

The troughs 150, 155 in this embodiment have curved and generally semi-circular cross-sectional shapes or profiles, with troughs 150, 155 and the sloping, depending front side walls 151, 153 and sloping depending rear side walls 152, 154 that are smoothly curvilinear, extending from the troughs 150, 155 to the respective edges 146, 148 of the channel 140. The troughs 150, 155 each form the deepest (i.e. most inwardly-recessed) portion of the channel 140 in this embodiment, while the troughs may have different depths in other embodiments. It is understood that the troughs 150, 155 and side walls 151, 152, 153, 154 may form different cross-sectional shapes or profiles, such as having sharper and/or more polygonal (e.g. rectangular, triangular, or trapezoidal) shapes in another embodiment where the front side walls 151, 153 may have different lengths or sloping angles than the rear side walls 152, 154. Additionally, the troughs 150, 155 within the center portion 130 of the channel 140 may have a generally constant (i.e. within 5%) depth across the entire length of the center portion 130. In another embodiment, the troughs 150, 155 within the center portion 130 of the channel 140 may generally increase in depth $D_{TX}$ so that the troughs 150, 155 have greater depths at and around the midpoint of the center portion 130 and are shallower more proximate the ends 131, 132.

The heel and toe portions 131, 132 of the troughs 150, 155 may have different cross-sectional shapes and/or profiles than the center portion of the troughs. For example, the heel and toe portions 131, 132 may have more angular and less smoothly-curved cross-sectional shapes as compared to the center portion of the troughs, which may have semi-circular or other curvilinear cross-section. In other embodiments, the troughs in the center portions may also be angularly shaped, such as by having a rectangular or trapezoidal cross section, and/or the heel and toe portions 131, 132 may have a more smoothly-curved and/or semi-circular cross-sectional shape. The troughs' cross-sections may transition smoothly between the center portions 130 and the heel and toe portions 131, 132. Alternatively, the transition between the troughs' center portions 130 and the heel and toe portions 131, 132 may be more abrupt and have a step feature where the cross-sectional shapes change.

Further, in one embodiment, the wall thickness $T_{TX}$ of the forward trough 150 may be reduced, as compared to the thickness of the rear trough 155, to provide for increased flexibility of the channel 140. In one embodiment, the wall thickness(es) T of the troughs within the channel (or different portions thereof) may be from 0.4 mm to 2.0 mm, or from 0.6 mm to 1.8 mm in another embodiment. The wall thickness $T_{TX}$ may also vary at different locations within the channel 140. For example, in one embodiment, the wall thickness $T_{TX}$ is slightly greater at the forward trough 150 than at the rear trough 155. In a different embodiment, the wall thickness may be larger at the rear trough 155 than at the forward trough 150. The wall thickness $T_{TX}$ in either of these embodiments may gradually increase or decrease to create these differences in wall thickness in one embodiment. In a further embodiment, all of the troughs, or at least the majority portion of the troughs may have a consistent wall thickness $T_{TX}$. It is understood that any of the embodiments in FIGS. 1-16 may have any of these wall thickness $T_{TX}$ configurations.

As discussed earlier, the channel 140 are spaced from the bottom edge 128 of the face member 112, with a spacing portion 164 defined between the front edge 146 of the channel 140 and the bottom edge 128. The spacing portion 164 comprises a portion sole 118 immediately adjacent the channel 140 and junctures with the front side wall 151 of the forward trough 150 along the front edge 146 of the channel 140, as shown in FIGS. 7-9. In this embodiment, the spacing portion 164 is oriented at an angle to the ball striking surface 114 and extends rearward from the bottom edge 128 of the face member 112 to the channel 140. In various embodiments, the spacing portion 164 may be oriented with respect to the ball striking surface 114 at an acute (i.e. <90°), obtuse (i.e. >90°), or right angle. Force from an impact on the face member 112 can be transferred to the channel 140 through the spacing portion 164, as described below.

The channel 140 of the head 102 shown in FIGS. 1-9 can influence the impact of a ball (not shown) on the face member 112 of the head 102. By having multiple troughs within the channel, the stiffness/flexibility of the head can be influenced to help produce the optimum response of the head as it impacts the golf ball. As the golf ball impacts the face member 112, the face member 112 flexes inwardly, and some of the impact force is transferred through the spacing portion 164 to the channel 140, which causes the troughs 150, 155 within the channel 140 to flex. This flexing of the troughs may assist in achieving greater impact efficiency, which can create greater ball speed for a golfer after impact by reducing the amount of deformation in the golf ball. Further, since the channel 140 has troughs 150, 155 that may have different characteristics on the heel 131 and toe 132 than at the center portion 130, the head 102 may improve ball speeds for impacts that are away from the center or traditional "sweet spot" of the face member 112 than if the channel's troughs had the same characteristics or if the head 102 had no channel at all. Additionally, the flexing of the body may affect the launch angle of the golf ball in both a vertical and horizontal direction. It is understood that one or more channels 140 may be additionally or alternately incorporated into the crown 116 and/or sides 120, 122 of the body 108 in order to produce similar effects. For example, in one embodiment, the head 102 may have one or more channels 140 extending completely or substantially completely around the periphery of the body 108, such as shown in U.S. patent application Ser. No. 13/308,036, filed Nov. 30, 2011, which is incorporated by reference herein in its entirety.

As discussed above, the troughs 150, 155 of the channel 140 may have different cross-sectional profiles and thicknesses in the center portion than the heel and toe portions 131, 132. These different cross-sectional profiles and thicknesses work in conjunction with the properties of the face member 112 to improve the impact efficiency of the club head 102. For instance, the face height 56 and face thickness can play a substantial role with regard to the impact efficiency of the club head. By being cognizant the face properties like the face height 56 and face thickness, one skilled in the art may select the parameters of the troughs 150, 155 of channel 140 such as thickness, width, cross-sectional profile of the channel, and position relative to the face to better optimize the club head 102 for improved impact efficiency both on center impacts and impacts away from the center of the face. The portions of the face member 112 around the face center 40 are generally the most flexible, and thus, less flexibility from the channel 140 may be needed for impacts proximate the face center 40. The portions of the face member 112 more proximate the heel 120 and toe 122 are generally less flexible, and thus, the heel and/or toe portions 131, 132 of the channel 140 may be more flexible to compensate for the reduced flexibility of the face member 112 for impacts near the heel 120 and the toe 122 when trying to equalize the COR across the entire face. In another embodiment, the center portion 130 of the channel 140 may be more flexible than the heel and toe portions 131, 132, to achieve different effects. For example, smaller trough widths $W_{TX}$, smaller trough depths $D_{TX}$, and larger trough wall thicknesses $T_{TX}$ can create a less flexible channel 140 (or portion thereof), a greater width $W_{TX}$, a greater depth $D_{TX}$, and a smaller wall thickness $T_{TX}$ can create a more flexible channel 140 (or portion thereof). Use of different structural materials and/or use of filler materials in different portions of the head 102 or different portions of the channel 140 can also create different flexibilities. The combination of the multiple troughs within the channel geometry allows one skilled in the art to better tune the channel to better optimize the club head to transfer more impact energy to the ball and/or increase ball speed on off-center hits, such as by reducing energy loss due to ball deformation.

The golf club head 102 may be formed using a method with the steps of (a) forming a golf club head body of a first material comprising a heel, a toe, a portion of a crown, and a portion of a sole; wherein the sole comprises an elongated channel with a plurality of troughs (b) forming a face member of a second material comprising a ball striking surface or a face member of a second material comprising a ball striking surface and a portion of the crown; (c) connecting the club head body and face member using an integral joining technique. Further, the second material may have a modulus of elasticity lower than a modulus of elasticity of the first material. The first material may be made of a titanium alloy, such as Ti-6V-4Al, while the second materials may be formed of material such as a beta-titanium alloy, gum metal™, vitreous alloys, metallic glasses or other amorphous metallic materials, non-metallic material, composite materials (carbon fiber and others), or other suitable material. Alternatively, the first material may be the same as the second material.

Face Design

The ball striking face may work in conjunction with the channel to improve the impact efficiency. The face member 112 may be formed of a single material or formed of a plurality of materials connected by an integral joining technique. For example, if the face member 112 may be integrally formed where a first material and a second material are welded as a flat sheet and subsequently formed either cold forming, forging, or other similar process to the appropriate shape to be joined to the club head body 108.

Additionally, the ball striking face portion 114 of the face member 112 may have constant thickness or it may have variable thickness. In one embodiment, the face member 112 of the head 102 in FIGS. 1-9 may be made from titanium alloy (e.g., Ti-6Al-4V alloy or Ti-15V-3Cr-3Sn-3Al, or other alloy); however, the face member 112 may be made from other materials in other embodiments such as a steel, carbon composite or even carbon fiber reinforced polymer.

It is understood that the face member 112, the body 108, and/or the hosel 110 can be formed as a single piece or as separate pieces that are joined together. The body 108 being partially or wholly formed by one or more separate pieces connected to the face member. These pieces may be connected by an integral joining technique, such as welding, cementing, or adhesively joining. Other known techniques for joining these parts can be used as well, including many mechanical joining techniques, including releasable mechanical engagement techniques. As one example, a body member formed of a single, integral, cast piece may be connected to a face member to define the entire club head. The head 102 in FIGS. 1-9 may be constructed using this technique, in one embodiment. As another example, a single, integral body member may be cast with an opening in the face and sole. The body member is then connected to a face member, and a separate sole piece is connected within the sole opening to completely define the club head. Such a sole piece may be made from a different material, beta-titanium, gum metal™, polymer or composite. As a further example, either of the above techniques may be used, with the body member having an opening on the top side thereof. A separate crown piece is used to cover the top opening and form part or the entire crown 116, and this crown piece may be made from a different material, beta-titanium, gum metal™, polymer or composite. As yet another example, a first piece including the face member 112 and a portion of the body 108 may be connected to one or more additional pieces to further define the body 108. For example, the first piece may have an opening on the top and/or bottom sides, with a separate piece or pieces connected to form part or all of the crown 116 and/or the sole 118. Further different forming techniques may be used in other embodiments.

Alternate Embodiments of Channel Feature

The previously discussed features apply to the alternative embodiments discussed below and with the exception of the distinguishing features discussed.

Figure 10:
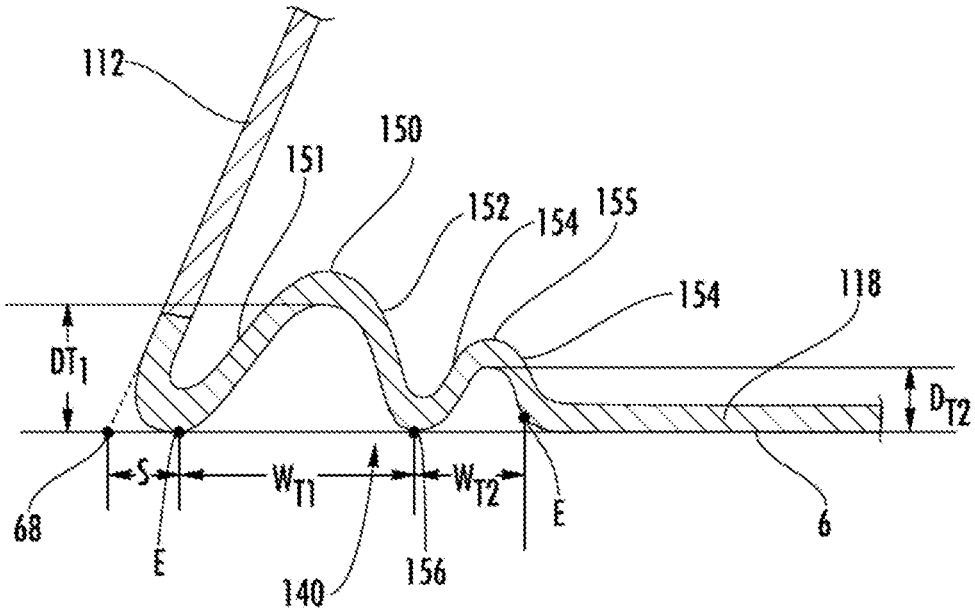
FIG. 10 is a magnified view of a portion of an alternate embodiment of the club head of FIG. 8.

FIG. 10 shows an alternate embodiment of head 102 having a channel similar in length and thickness to the embodiment shown in FIG. 9. For embodiment of FIG. 10, the channel 140 may be have multiple troughs 150, 155, where the forward trough has a much larger width $W_{T1}$ and depth $D_{T1}$ than the width $W_{T2}$ and depth $D_{T2}$ of the rear trough. As depicted the width $W_{T1}$ may be between 1.5 and 2.5 times larger than the width $W_{T2}$. Additionally, the depth $D_{T1}$ may be between 1.5 and 2.5 times larger than the depth $D_{T2}$. This ratio of width and depth between the forward trough and the rear trough may only apply to a center portion of the channel or may apply to the entire length of the channel if the width is substantially constant. If additional troughs are present such as three or four troughs, the ratios would apply to the forward most trough (or the trough closest the ball striking surface) and the rearward most trough.

Figure 11:
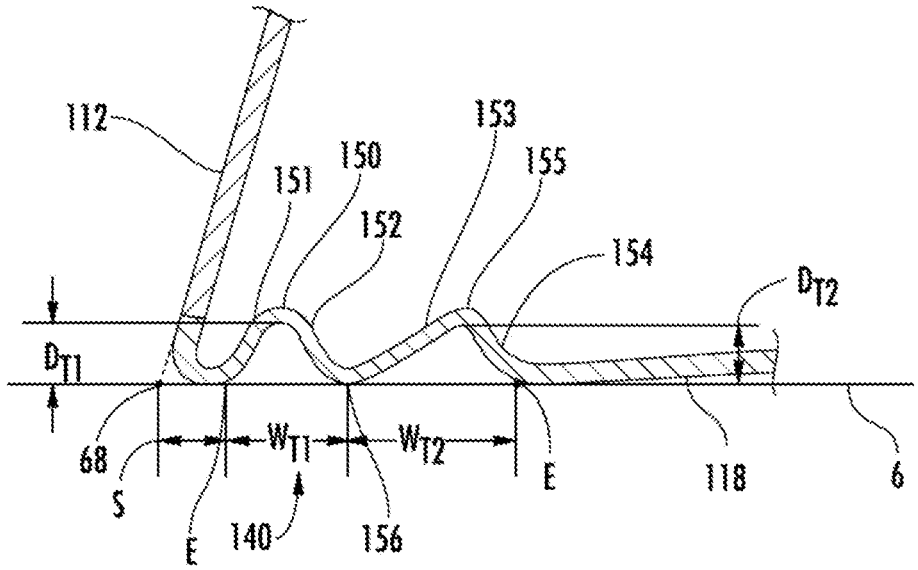
FIG. 11 is a magnified view of a portion of an alternate embodiment of the club head of FIG. 8.

FIG. 11 illustrates an additional alternate embodiment of head 102 where the forward trough 150 may have a different cross-sectional profile or shape than the rear trough 155. In FIG. 11, while the depths of each trough are similar to each other, the front sloping side wall 153 of the rear trough 155 is longer than the rear sloping side wall 154 of the rear trough 155 creating an asymmetric cross-sectional shape for the rear trough or where the front sloping side wall 153 of the rear trough 155 is shorter than the rear sloping side wall 154 of the rear trough 155. Additionally, the width of the rear trough may have a larger width $W_{T2}$ than the width $W_{T1}$. Alternatively, the forward trough 150 may have a cross-sectional shape with an asymmetrical cross-sectional shape where the front sloping side wall 151 is longer than the rear sloping side wall 152 or where the front sloping side wall 153 of the rear trough 155 is shorter than the rear sloping side wall 154 of the rear trough 155.

Figure 12:
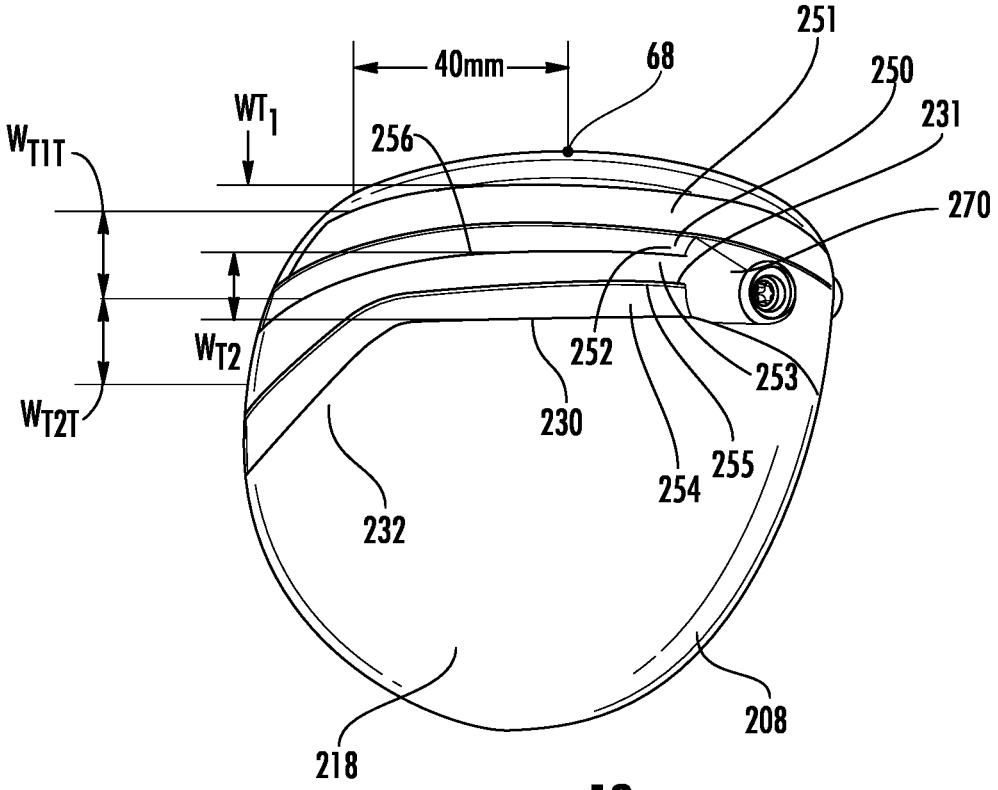
FIG. 12 is a magnified view of a portion of an alternate embodiment of the club head of FIG. 8.
Figure 13:
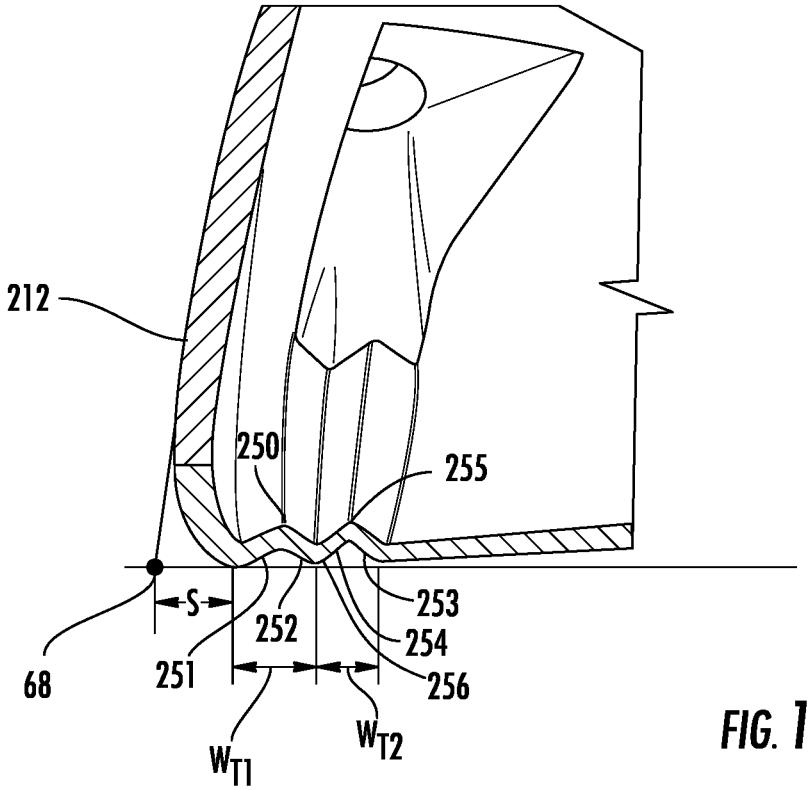
FIG. 13 is a magnified view of a portion of an alternate embodiment of the club head of FIG. 8.

FIGS. 12-13 demonstrate an additional alternate embodiment of head 102 where the features are referred to using similar reference numerals under the "2xx" series of reference numerals, rather than "1xx" as used in the embodiment of FIGS. 1-9. Accordingly, certain features of the head 202 that were already described above with respect to head 102 of FIGS. 1-9 may be described in lesser detail, or may not be described at all. As illustrated in FIGS. 12 and 13, the forward trough 250 and the center portion of the rear trough 255 have a similar cross-sectional shape, but the heel and toe portions 231, 232 of the rear trough may have a width larger than the width of the forward trough 250 at its corresponding location in the X-Axis 14 direction. Additionally, the troughs 250, 255 have a cross-sectional profile that has a front sloping side wall and a rear sloping side that either connect directly together or are connected only with a minimal radius between them. For example, FIG. 13 shows the front sloping side wall 251 and the rear sloping side wall 252 that intersect at the trough 250 with a minimal radius between them, although the channel and troughs may have any cross-sectional profile. This width of the toe and heel section may increase at a linear rate relative to the rear side wall 252 of the forward trough 250. Alternatively, the width of the toe and heel sections may increase at a non-linear rate relative to the rear side wall 252 of the forward trough 250. This width of the rear trough 255 may be given by the dimensions, $W_{TXH}$ and $W_{TXT}$, where "x" designates the trough with the forward most trough being designated 1 and the subsequent troughs are sequentially numbered, and the "H" and "T" designating the either the heel or the toe side at a distance approximately 40 mm on either side of the face center 40.

Figure 14:
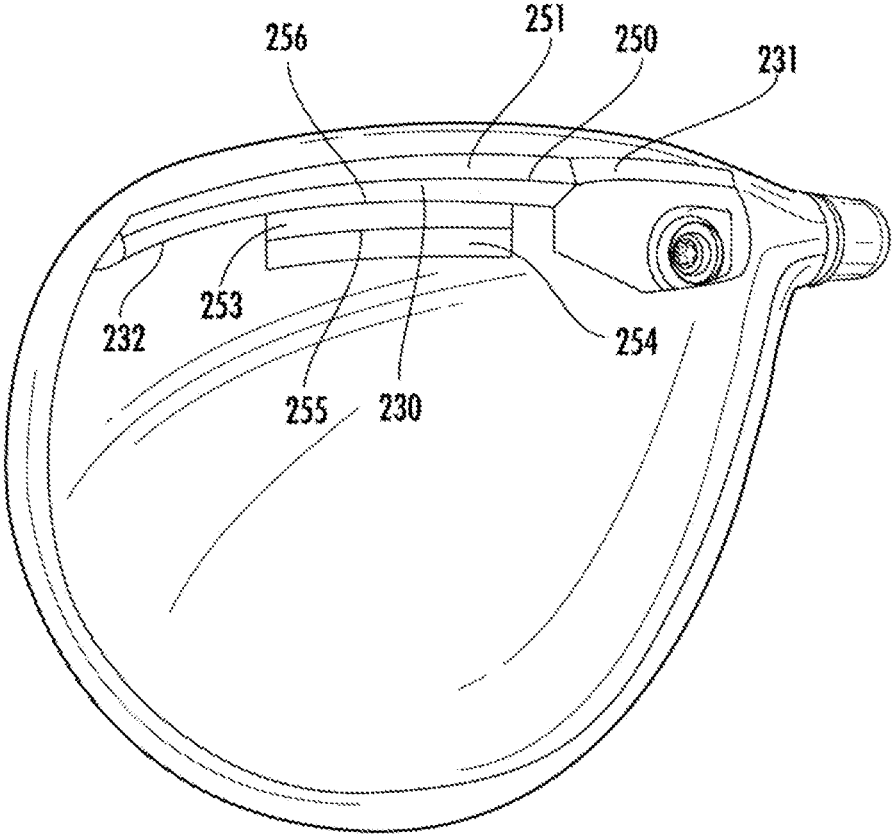
FIG. 14 is a magnified view of a portion of an alternate embodiment of the club head of FIG. 8.

FIG. 14 shows another embodiment similar to the embodiments of FIGS. 12 and 13 where the forward trough 250 and the rear trough 255 may have different lengths and may be positioned in different locations. For example, the forward trough 250 may have a center portion 230, a toe portion 232, and a heel portion 231, while the second trough 255 may only have a center portion or conversely, the second trough may only have a heel portion and/or only a toe portion. Alternatively, the forward trough 250 may only have a center portion 230 or only have a heel portion and/or only a toe portion, while the rear trough may extend completely from the heel to the toe.

Figure 15:
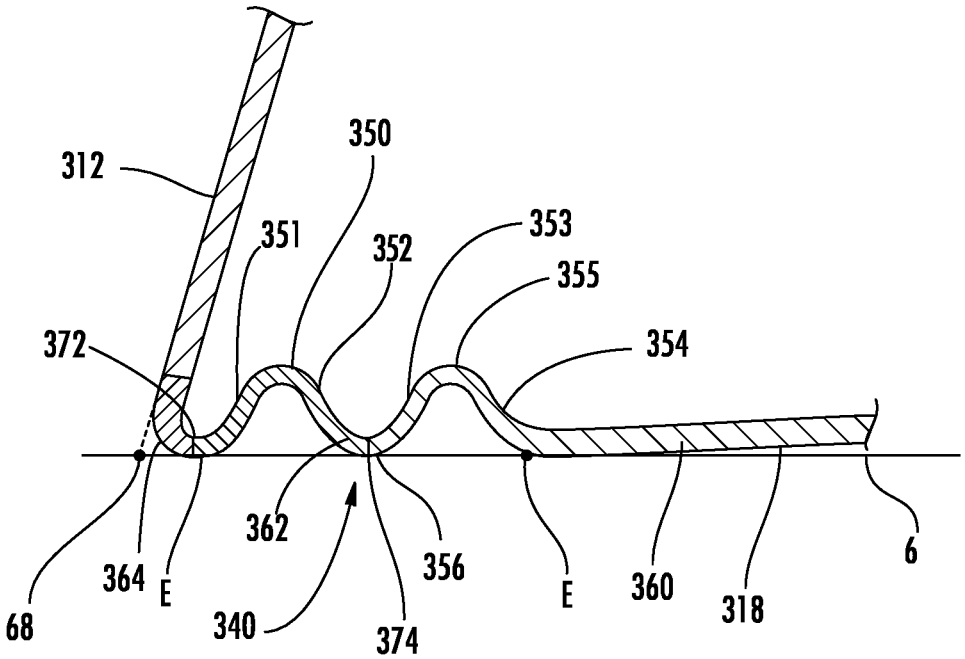
FIG. 15 is a bottom view of an alternate embodiment of the club head of FIG. 1.

FIG. 15 shows another alternative embodiment of head 102. For the embodiment of FIG. 15, the features are referred to using similar reference numerals under the "3xx" series of reference numerals, rather than "1xx" as used in the embodiment of FIGS. 1-9. Accordingly, certain features of the head 302 that were already described above with respect to head 102 of FIGS. 1-9 may be described in lesser detail, or may not be described at all. The head 302 of this embodiment has a channel 340 with a plurality of troughs 350, 355 similar to the previous embodiments described herein, however, the sole comprises a plurality of materials where at least a portion of the first trough 350 of the channel 340 may be made of a material different than the remainder of the sole 318. The sole 318 comprises a plurality of members where at least a first sole member 360, which may be a part of the club head body 108, may be made of a first material and a second sole member 362 may be made of a second material with a lower modulus of elasticity than the first material. For example, the first material may be the same material as the remainder of the club head body 308 such as a Ti-8Al-1Mo-1V or a Ti-6Al-4V alloy, or other suitable alloy, while the second material may be a material such as a beta titanium alloy, gum metal™, vitreous alloys, metallic glasses or other amorphous metallic materials, composite materials (carbon fiber and others), or other suitable material. The second sole member 362 may be integrally joined to the first sole member 360 on at least four sides or alternatively be attached on a forward edge 372 attached to the first sole member 360 and a rear edge 374 attached to a third member 361 made from the same material as the first sole member.

The modulus of elasticity is a measurement of a material's resistance to a force and not be permanently deformed. The higher the modulus of elasticity, the stiffer the material. By having a modulus of elasticity lower than that of the first material, the second sole member creates an area that may deform greater than the surrounding area during the impact with a golf ball. This deformation within the body, as long as it does not cause permanent deformation of the material, may improve the efficiency of the collision or COR by keeping a golf ball from losing as much energy during an impact with a golf club.

The club head body may be made of a titanium alloy. Titanium alloys may have a variety of modulus of elasticity properties, but typically range between 100 GPa and 140 GPa. For example, the modulus of elasticity of common titanium alpha-beta alloys such as Ti-6Al-4V alloy is approximately 114 GPa, while Ti-8Al-1Mo-1V which is an alpha/near alpha alloy has a modulus of approximately 121 GPa. While a typical beta titanium alloy such as Ti-15V-3Cr-3Sn-3Al has a modulus of approximately 100 GPa. For some titanium alloys, the elastic modulus may be affected by cold working a titanium alloy and aligning the grain structure in a specific direction. For example, the titanium alloy SP700 from JFE steel may have a modulus of elasticity ranging from approximately 109 GPa to 137 GPa depending upon the direction the grain is oriented after cold working.

However, gum metal™ is a unique titanium alloy that has a combination of a relatively low modulus of elasticity with a yield strength comparable or higher than titanium alloys. Gum metal™ may have a modulus of elasticity of approximately 80 GPa or in a range of 85 GPa to 95 GPa, but the modulus of elasticity may be modified by a work hardening process, like cold working, to approximately 45 GPa, or in a range between 30 GPa and 60 GPa. However, gum metal™ may have a density of approximately 5.6 grams per cubic centimeter, which is higher than that of a titanium alloy, which may be within a range of 4.5 to 4.8 grams per cubic centimeter. This lower modulus of elasticity combined with its high yield strength may make it an ideal material to provide an elastically deformable region in the golf club body, while the higher density may restrict the use of gum metal™ to targeted regions.

The relationship between the modulus of elasticity of the material of the second sole member 362 and the modulus of elasticity of the first sole member 360 may be where the modulus of elasticity of the material of the second sole member may be at least 5% lower than the modulus of elasticity of the first sole member 360, or at least 10% lower, or even at least 20% lower. The modulus of the material is recognized to be in the proper heat treatment condition of the finished golf club head to enable the golf club head to be durable as one skilled in the art would define it.

The forward trough 350 of the channel 340 may be formed within the second sole member 362. The forward edge 372 of the second sole member 362 may be positioned where the front side wall 351 of the forward trough 350 communicates with the spacing portion 364 of the sole 318. Alternatively, the second sole member 362 may comprise the forward trough 350 and a part of the spacing portion 364.

The forward edge 372 of the second sole member 362 may be generally parallel to the edge 128 of the club face 114. The second sole member 362 may be generally rectangular in shape or may have any number of edges with curvature or alternatively, the edges may not have any curvature.

The thickness of the second sole member 362 may be equal to or less than the surrounding thickness of the first sole member 360. The overall thickness of second sole member 362 may be constant or may have a variable thickness. The thickness of the second sole member 362 may be approximately 1.0 mm, within a range of 0.6 mm and 2 mm, or within a range of 0.4 mm to 2.5 mm.

The combination of a multiple trough channel geometry and a lower modulus material than the surrounding material allows one skilled in the art to better tune the channel to better optimize the club head to transfer more impact energy to the ball and/or increase ball speed on off-center hits, such as by reducing energy loss due to ball deformation.

Figure 16:
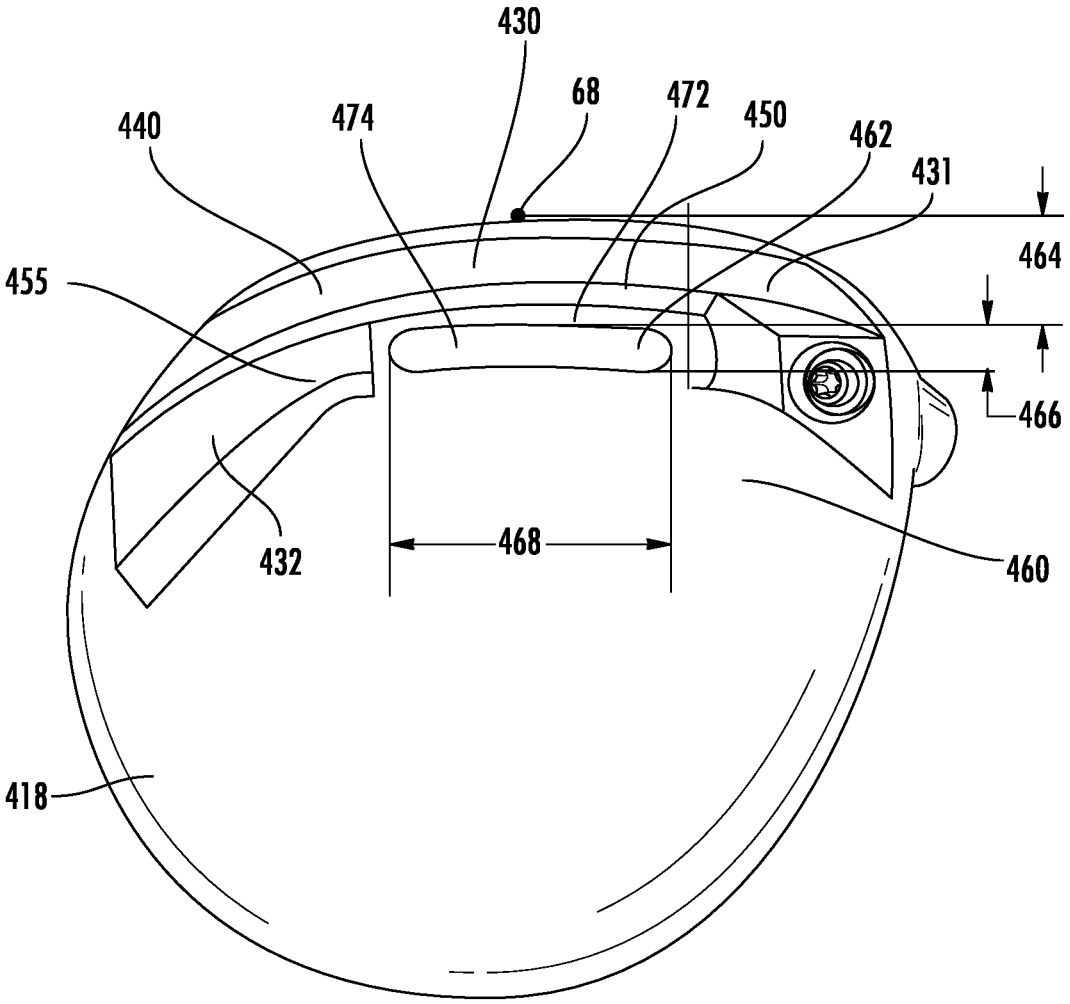
FIG. 16 is a bottom view of an alternate embodiment of the club head of FIG. 1.

FIG. 16 shows another alternative embodiment of head 102. For the embodiment of FIG. 16, the features are referred to using similar reference numerals under the "4xx" series of reference numerals, rather than "1xx" as used in the embodiment of FIGS. 1-9. Accordingly, certain features of the head 402 that were already described above with respect to head 102 of FIGS. 1-9 may be described in lesser detail, or may not be described at all. This embodiment has a channel 440 with a plurality of troughs similar to the previous embodiments described herein, however, the forward trough 450 comprises a heel portion, a toe portion and a center portion, but the rear trough 455 comprises only a heel and/or a toe portion 431, 432. The sole 418 comprises a plurality of members where a first sole member 460 made of a first material comprises at least the first trough 450 and a portion of the rear trough and a second sole member 462 made of a second material, having a lower modulus of elasticity than the first material, comprising a portion of the sole. For example, the first material may be the same material as the remainder of the club head body 408 such as a Ti-8Al-1Mo-1V or a Ti-6Al-4V alloy, or other suitable alloy, while the second material has a lower modulus of elasticity than the first material. The second material may be a material with a lower modulus of elasticity such as a beta titanium alloy, gum metal™, vitreous alloys, metallic glasses or other amorphous metallic materials, composite materials (carbon fiber and others), or other suitable material. The second sole member 462 may be integrally joined to the first sole member 460 on at least four sides or alternatively be attached on a forward edge 472 attached to the first sole member 460 and a rear edge 474 attached to a third member 461 made from the same material as the first sole member.

Here, the forward trough 450 may have a length that spans across the majority of the sole, where the length in a heel-to-toe direction of the forward trough is longer than a length in a heel-to-toe direction of the rear trough. The rear trough 455 may have only a toe portion, only a heel portion, or only a toe and heel portion, or possibly only a center portion. The second sole member 462 may follow the contour of the sole 418 surface and be positioned on the sole in proximity to the troughs 450, 455. For example, as shown in FIG. 16, the second sole member 462 may be positioned in a location rearward of the center portion of the forward trough 450 and may have a forward edge 472 positioned within 10 mm in a Y-Axis direction of the rear edge of the forward trough 450. Alternatively, the position of the second sole member 462 may be defined as the distance 464 from the sole-face intersection point 68 in a direction parallel to the Y-axis 16 to the forward most point of the forward edge 472. The distance 464 of the second sole member 462 may be approximately 45 mm or within a range of 35 mm to 55 mm or within a range of 25 mm to 65 mm. The forward edge 472 that may have a curvature that is generally parallel to the edge 428 of the striking face 414. The second sole member may have a substantially constant width, where the forward edge 472 is parallel with the rear edge 474, or have a generally rectangular shape or it may be any shape. The corners of the second sole member 462 may have generous radii on the corners to avoid sharp corners in a high stress area. The rear edge 474 may be generally parallel to the forward edge 472. The center width dimension 466 may be defined as the distance from the forward most point of the forward edge 472 to the most rearward point of the rear edge 466 in a direction of the Y-axis 16 within a cross-section created by a plane passing through the face center 40. The center width dimension 466 of the second sole member 462 may be approximately 6 mm or may be within a range of 4 mm to 8 mm, or within a range of 3 mm to 12 mm. Additionally, the length 468, in a heel-to-toe direction may be approximately 40 mm or may be within a range of 30 mm to 50 mm or within a range of 20 mm to 60 mm.

The golf club head 402 may be formed using a method with the steps of (a) forming a golf club head body of a first material comprising a heel, a toe, a portion of a crown, and a portion of a sole; wherein the club head body comprises an elongated channel having a plurality of troughs; (b) forming a face member of a second material comprising a ball striking surface or a face member of a second material comprising a ball striking surface and a portion of the crown; (c) forming a sole member of a third material comprising a portion of the sole; (d) connecting the club head body, the face member, and the sole member with an integral joining technique. Further, the third material has a modulus of elasticity lower than a modulus of elasticity of the first and second materials, where the first material may be made of a titanium alloy, such as Ti-6V-4Al, while the third material may be formed of material such as a beta-titanium alloy, gum metal™, vitreous alloys, metallic glasses or other amorphous metallic materials, non-metallic material, composite materials (carbon fiber and others), or other suitable material.

It is understood that one or more different features of any of the embodiments described herein can be combined with one or more different features of a different embodiment described herein, in any desired combination. It is also understood that further benefits may be recognized as a result of such combinations. Golf club heads 102 may contain any number of sole features such as channels or lower modulus regions in combination with the features of the embodiments disclosed herein.

Golf club heads 102 incorporating the body structures disclosed herein may be used as a ball striking device or a part thereof. For example, a golf club 100 as shown in FIG. 1 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. For example, a set of golf clubs may include one or more drivers, one or more fairway wood clubs, and/or one or more hybrid clubs having features as described herein. In other embodiments, different types of ball striking devices can be manufactured according to the principles described herein. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefore having a channel with multiple troughs as described herein provide many benefits and advantages over existing products. For example, the flexing of the channel with multiple troughs results in a smaller degree of deformation of the ball, which in turn can result in greater impact efficiency and greater ball speed at impact. Additionally, the shapes of the channels may also affect the launch angle the ball is directed off the club face. Still further, because the channel may become larger toward the heel and toe edges 128 of the ball striking surface 114, the head 102 can achieve increased ball speed on impacts that are away from the center or traditional "sweet spot" of the ball striking surface 114. Further benefits and advantages are recognized by those skilled in the art.

The benefits of the channel 140 with multiple troughs and other body structures described herein can be combined together to achieve additional performance enhancement. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a club head body member made of a first material comprising a heel, a toe, a portion of a crown, and a portion of a sole;

a face member made of a second material comprising a portion of a striking face and a portion of the crown adjacent to the striking face; and an elongated channel extending across a portion of the sole in a heel-to-toe direction, wherein the elongated channel is recessed from adjacent surfaces of the sole and has a depth of recession from the adjacent surfaces of the sole, wherein the sole comprises a plurality of materials such that the elongated channel and its adjacent surfaces are a third material, wherein the elongated channel consists of a forward trough and a rear trough;

wherein the forward trough further comprises a forward trough toe portion, a forward trough center portion, and a forward trough heel portion;

wherein the rear trough further comprises at least one of a rear trough toe portion, a rear trough center portion, and a rear trough heel portion;

wherein the forward trough and rear trough consist of a semicircular cross-sectional shape;

wherein the forward trough and the rear trough are open to the exterior of the golf club head, wherein a width of the rear trough is between 1.5 and 2.5 times larger than a width of the forward trough, wherein the forward trough comprises a forward trough wall thickness and the rear trough comprises a rear trough wall thickness, wherein the forward trough wall thickness is less than the rear wall trough thickness wherein the forward trough has a forward trough front wall and a forward trough rear wall, wherein the rear trough has a rear trough front wall and a rear trough rear wall, wherein the forward trough rear wall and the rear trough front wall meet at an inflection point, wherein the forward trough rear wall and the rear trough front wall form an interior trough open to the interior of the golf club head such that the forward trough rear wall and the rear trough front wall slope in opposite directions away from each other in relationship to the inflection point;

wherein a depth of recession of the forward trough center portion is in a range of 5 mm to 10 mm.

2. The golf club head of claim 1, wherein the third material has a modulus of elasticity that is lower than a modulus of elasticity of the first material.

3. The golf club head of claim 1, wherein a width of the elongated channel from a front edge to a rear edge is substantially constant.

4. The golf club head of claim 1, wherein a depth of the rear trough is greater than a depth of the forward trough.

5. The golf club head of claim 1, wherein the first material has a modulus of elasticity that is greater than either of the second material or the third material.

6. The golf club head of claim 1, wherein the third material is gum metal.

7. The golf club head of claim 1, wherein the third material has a forward edge located a distance measured from a sole-intersection point between in a Y-Axis direction between 5 mm and 20 mm.

8. A golf club head comprising:

a club head body member made of a first material comprising a heel, a toe, a portion of a crown, and a sole;

a face member made of a second material comprising a portion of a striking face; and an elongated channel extending across a portion of the sole in a heel-to-toe direction, wherein the elongated channel is recessed from adjacent surfaces of the sole and has a depth of recession from the adjacent surfaces of the sole, wherein the elongated channel consists of a forward trough and a rear trough;

wherein the forward trough further comprises a forward trough toe portion, a forward trough center portion, and a forward trough heel portion;

wherein the rear trough further comprises at least one of a rear trough toe portion, a rear trough center portion, and a rear trough heel portion;

wherein the forward trough and rear trough consist of a semicircular cross-sectional shape;

wherein a width of the rear trough is between 1.5 and 2.5 times larger than a width of the forward trough, wherein the forward trough comprises a forward trough wall thickness and the rear trough comprises a rear trough wall thickness, wherein the rear trough wall thickness is less than the forward wall trough thickness, wherein the forward trough has a forward trough front wall and a forward trough rear wall, wherein the rear trough has a rear trough front wall and a rear trough rear wall, wherein the forward trough rear wall and the rear trough front wall meet at an inflection point, wherein the forward trough rear wall and the rear trough front wall form an interior trough open to the interior of the golf club head such that the forward trough rear wall and the rear trough front wall slope in opposite directions away from each other in relationship to the inflection point;

wherein a depth of recession of the forward trough center portion is in a range of 5 mm to 10 mm.

9. The golf club head of claim 8, wherein the elongated channel from a front edge of the elongated channel to a rear edge of the elongated channel is substantially constant.

10. The golf club head of claim 8, wherein a depth of the rear trough is greater than a depth of the forward trough.

11. The golf club of claim 8, wherein the elongated channel has a forward edge located a distance measured from a sole-intersection point between in a Y-axis direction between 5 mm and 20 mm.

12. A golf club head comprising:

a club head body member made of a first material comprising a heel, a toe, a portion of a crown, and a portion of a sole;

a face member made of a second material comprising a portion of a striking face; a portion of the sole made of a third material; and an elongated channel extending across a portion of the sole, wherein the elongated channel is recessed from adjacent surfaces of the sole and has a depth of recession from the adjacent surfaces of the sole, wherein the depth of recession is in a range of 2 mm to 5 mm;

the elongated channel consisting of a forward trough and a rear trough;

wherein the forward trough further comprises a forward trough toe portion, a forward trough center portion, and a forward trough heel portion;

wherein the rear trough further comprises at least one of a rear trough toe portion, a rear trough center portion, and a rear trough heel portion;

wherein the forward trough and rear trough consist of a semicircular cross-sectional shape;

wherein a width of the rear trough is between 1.5 and 2.5 times larger than a width of the forward trough, wherein the forward trough comprises a forward trough toe portion wall thickness, a forward trough center portion wall thickness, and a forward trough heel portion wall thickness, and wherein the rear trough comprises at least one of a rear trough toe portion wall thickness, a rear trough center portion wall thickness, and a rear trough heel portion wall thickness, wherein the forward trough center portion wall thickness is greater than the forward trough toe portion wall thickness, wherein the forward trough center portion wall thickness is greater than the forward trough heel portion wall thickness, and wherein the forward trough toe portion wall thickness, the forward trough center portion wall thickness, and the forward trough heel portion wall thickness are each less than at least one of a rear trough toe portion wall thickness, a rear trough center portion wall thickness, and a rear trough heel portion wall thickness.

13. The golf club head of claim 12, wherein a length in a heel-to-toe direction of the rear trough is longer than a length in a heel-to-toe direction of the forward trough.

14. The golf club head of claim 12, wherein the third material has a modulus of elasticity lower than a modulus of elasticity of the first material.

15. The golf club head of claim 12, wherein the third material has a modulus of elasticity that is at least 10 percent lower than the modulus of elasticity of the first material.

16. The golf club head of claim 12, wherein at least a portion of the forward trough is made of the third material.

17. The golf club head of claim 12, wherein the third material is located rearward of the center portion of the forward trough.

18. The golf club head of claim 12, wherein the face member comprises a portion of the striking face and a portion of the crown surface.

19. The golf club head of claim 12, wherein an opening for a shaft interconnection structure intersects the elongated channel.

20. The golf club head of claim 12, wherein the rear trough consists of a rear trough toe portion and a rear trough heel portion.

* * * * *